US007182837B2

(12) United States Patent
Chen et al.

(10) Patent No.: US 7,182,837 B2
(45) **Date of Patent: *Feb. 27, 2007**

(54) STRUCTURAL PRINTING OF ABSORBENT WEBS

(75) Inventors: Fung-Jou Chen, Appleton, WI (US); Jeffrey D. Lindsay, Appleton, WI (US); Thomas F. Hunt, Appleton, WI (US); Maurizio Tirimacco, Appleton, WI (US); John J. Urlaub, Oshkosh, WI (US)

(73) Assignee: Kimberly-Clark Worldwide, Inc., Neenah, WI (US)

( * ) Notice: Subject to any disclaimer, the term of this patent is extended or adjusted under 35 U.S.C. 154(b) by 267 days.

This patent is subject to a terminal disclaimer.

(21) Appl. No.: 10/305,791

(22) Filed: Nov. 27, 2002

(65) Prior Publication Data

US 2004/0099388 A1 May 27, 2004

(51) Int. Cl.
*D21H 23/56* (2006.01)

(52) U.S. Cl. ..... 162/134; 162/109; 162/111; 162/117; 162/125; 162/204; 428/153; 428/156; 156/277; 264/121

(58) Field of Classification Search ..... 162/134, 162/135–137, 109, 111–113, 117, 123, 125, 162/127, 204, 206; 428/152, 153, 156, 195.1, 428/537.5; 427/361, 391; 156/60, 244.16, 156/277; 264/121, 129, 132
See application file for complete search history.

(56) References Cited

U.S. PATENT DOCUMENTS 3,260,778 A 7/1966 Walton
3,696,183 A 10/1972 Steel et al.
3,708,565 A 1/1973 Seiffert
3,810,280 A 5/1974 Walton et al.
3,870,778 A 3/1975 Steel
3,879,257 A 4/1975 Gentile et al.
3,906,128 A 9/1975 Burling et al.

(Continued)

FOREIGN PATENT DOCUMENTS

EP 1262243 A1 12/2002

(Continued)

OTHER PUBLICATIONS

Abstract of Japanese Publication 2000313082, Nov. 14, 2000.

(Continued)

*Primary Examiner*—José A. Fortuna
(74) *Attorney, Agent, or Firm*—Dority & Manning, P.A.

(57) ABSTRACT

A process and method which 'locks in' three-dimensional texturing added to a paper web by virtue of an adhesive material which is printed onto the surface of the web is generally disclosed. The adhesive may be applied to the web either before, during, or after the web is molded to increase the surface texture. The adhesive may be applied at relatively low pressure so as to preserve surface texture without significant deformation of the web. The cured adhesive material inhibits the web from reassuming a two-dimensional state or may contribute additional texture by rising above the surface of the web. This process may not only increase the bulk of the web when dry and wet, but also increase the wet resiliency, the wet strength, and the tactile properties of the web.

39 Claims, 16 Drawing Sheets

U.S. PATENT DOCUMENTS 3,948,665 A 4/1976 Richter et al.
3,953,638 A 4/1976 Kemp
3,976,820 A 8/1976 Giovanelli et al.
4,076,874 A 2/1978 Giovanelli et al.
4,143,890 A 3/1979 Davis et al.
4,181,762 A 1/1980 Benedyk
4,183,889 A 1/1980 Brendel
4,205,991 A * 6/1980 Becker et al. ..... 524/87
4,225,384 A 9/1980 Valkama
4,264,705 A 4/1981 Allen
4,309,179 A * 1/1982 Heuser et al. ..... 8/558
4,377,544 A 3/1983 Rasmussen
4,436,687 A 3/1984 Bye et al.
4,451,419 A 5/1984 Bye et al.
4,514,345 A 4/1985 Johnson et al.
4,517,278 A 5/1985 Sakurai
4,528,239 A 7/1985 Trokhan
4,578,504 A 3/1986 Hammar
4,637,859 A 1/1987 Trokhan
4,786,657 A 11/1988 Hammar et al.
4,919,877 A 4/1990 Parsons et al.
4,921,643 A 5/1990 Walton et al.
5,015,556 A 5/1991 Martens
5,019,211 A 5/1991 Sauer
5,048,589 A 9/1991 Cook et al.
5,098,522 A 3/1992 Smurkoski et al.
5,120,360 A 6/1992 Tajiri et al.
5,175,072 A 12/1992 Martens
5,187,044 A 2/1993 Prioleau et al.
5,215,859 A 6/1993 Martens
5,279,697 A 1/1994 Peterson et al.
5,322,761 A 6/1994 Kausch et al.
5,334,289 A 8/1994 Trokhan et al.
5,399,412 A 3/1995 Sudall et al.
5,429,686 A 7/1995 Chiu et al.
5,462,835 A 10/1995 Mirle et al.
5,558,020 A 9/1996 Marozzi et al.
5,562,645 A 10/1996 Tanzer et al.
5,565,255 A 10/1996 Young et al.
5,607,760 A 3/1997 Roe
5,609,587 A 3/1997 Roe
5,656,132 A 8/1997 Farrington, Jr. et al.
5,670,110 A 9/1997 Dirk et al.
5,743,999 A 4/1998 Kamps et al.
5,772,845 A 6/1998 Farrington, Jr. et al.
5,798,202 A 8/1998 Cushner et al.
5,858,554 A * 1/1999 Neal et al. ..... 428/537.5
5,885,697 A 3/1999 Krzyski et al.
5,904,811 A 5/1999 Ampulski et al.
5,916,732 A 6/1999 Sasashita et al.
5,976,763 A 11/1999 Roberts et al.
5,990,377 A 11/1999 Chen et al.
6,017,417 A 1/2000 Wendt et al.
6,043,317 A 3/2000 Mumick et al.
6,096,412 A 8/2000 McFarland et al.
6,103,061 A 8/2000 Anderson et al.
6,103,062 A 8/2000 Ampulski et al.
6,126,784 A * 10/2000 Ficke et al. ..... 162/184
6,129,815 A 10/2000 Larson et al.
6,187,137 B1 2/2001 Druecke et al.
6,197,459 B1 3/2001 Leach
6,197,479 B1 3/2001 Tanaka et al.
6,214,274 B1 4/2001 Melius et al.
6,231,719 B1 5/2001 Garvey et al.
6,248,212 B1 6/2001 Anderson et al.
6,287,581 B1 9/2001 Krzysik et al.
6,322,665 B1 * 11/2001 Sun et al. ..... 162/158
6,395,957 B1 5/2002 Chen et al.
6,410,097 B2 * 6/2002 Kume et al. ..... 427/387
6,423,180 B1 7/2002 Behnke et al.
6,429,261 B1 8/2002 Lang et al.
6,436,234 B1 8/2002 Chen et al.
6,447,643 B2 * 9/2002 Fingal et al. ..... 162/109
6,500,289 B2 * 12/2002 Merker et al. ..... 156/183
6,841,590 B2 * 1/2005 Modi et al. ..... 523/160
2002/0180092 A1 * 12/2002 Abba et al. ..... 264/112
2004/0020614 A1 * 2/2004 Lindsay et al. ..... 162/109
2004/0099388 A1 * 5/2004 Chen et al. ..... 162/134
2004/0099389 A1 * 5/2004 Chen et al. ..... 162/134

FOREIGN PATENT DOCUMENTS

EP 1262531 A1 12/2002
GB 1378638 12/1974
WO WO 9711226 A1 3/1997
WO WO 9718784 A1 5/1997
WO WO 9920822 A1 4/1999
WO WO 0020682 A1 4/2000
WO WO 0030582 A1 6/2000
WO WO 0048544 A1 8/2000
WO WO 0071334 A1 11/2000
WO WO 0119306 A1 3/2001
WO WO 0120079 A1 3/2001
WO WO 200126592 A1 * 4/2001
WO WO 200126595 A1 * 4/2001
WO WO 0131123 A1 5/2001
WO WO 0147700 A1 7/2001
WO WO 02081819 A1 10/2002
WO WO 02098571 A2 12/2002
WO WO 02098999 A2 12/2002
WO WO 03057965 A1 7/2003

OTHER PUBLICATIONS

Abstract of Article entitled "Vivelle" by C. Knight, UMIST Non-woven Conference, Paper No. 16, Jun. 1983, pp. 353-362.
PCT Search Report for PCT/US03/38064, Jun. 7, 2004.
PCT Search Report for PCT/US03/27316, May 4, 2004.

* cited by examiner

Physical Properties from Latex Printing Trials

| Sample Description | No. Sides Printed | CD Wet/Dry % | MD Dry Tensile | | CD Dry Tensile | | CD Wet Tensile | | Caliper,in. 0.289 psi |
|---|---|---|---|---|---|---|---|---|---|
| | | | g/3"x4" | % Stretch | g/3"x4" | % Stretch | g/3"x4" | % Stretch | |
| Control 1: Off Roll | 0 | 12 | 592.7 | 22.0 | 464.7 | 8.2 | 56.2 | 4.5 | 0.0283 |
| Control 2: Through Process | 0 | 12 | 585.1 | 18.4 | 453.2 | 8.5 | 56.2 | 4.6 | 0.0282 |
| 0.006" Gap | 1 | 15 | 601.6 | 16.7 | 434.1 | 8.2 | 63.0 | 4.5 | 0.0295 |
| 0.008" Gap | 1 | 15 | 585.5 | 19.8 | 489.3 | 7.6 | 73.6 | 5.1 | 0.0293 |
| 0.008" Gap, Higher Add-On | 1 | 14 | 606.0 | 20.9 | 475.8 | 8.1 | 68.1 | 4.3 | 0.0272 |
| 0.010" Gap | 1 | 13 | 576.8 | 19.2 | 485.8 | 7.8 | 64.7 | 4.4 | 0.0286 |
| 0.002" Gap | 2 | 24 | 1253.9 | 17.3 | 929.5 | 10.8 | 222.9 | 9.2 | 0.0232 |
| 0.004" Gap | 2 | 26 | 1064.1 | 24.3 | 758.8 | 9.8 | 196.6 | 9.0 | 0.0289 |
| 0.008" Gap | 2 | 16 | 695.1 | 23.3 | 610.5 | 8.8 | 99.7 | 6.8 | 0.0301 |

FIG. 15

STRUCTURAL PRINTING OF ABSORBENT WEBS

BACKGROUND OF THE INVENTION

Products made from paper webs such as bath tissues, facial tissues, paper towels, industrial wipers, food service wipers, napkins, medical pads and other similar products are designed to include several important properties. For example, the product should have a relatively soft feel and, for most applications, should be highly absorbent. High bulk is also often preferred in such products. For example, three dimensional, high bulk paper products are often preferred over thinner, more two-dimensional products.

Several methods have been proposed in the past for imparting three-dimensional structures to a fibrous paper web. One well-known method is embossing, wherein the fibers in the web are mechanically deformed under high mechanical pressure to impart kinks and microcompressions in the fibers that remain substantially permanent while the web is dry. When wetted, however, the fibers may swell and straighten as the local stresses associated with the kinks or microcompressions in the fiber relax. Thus, embossed tissue when wetted tends to lose much of the added bulk imparted by embossing, and tends to collapse back to a relatively flat state. Similar considerations apply to the fine texture imparted to tissue by creping or microstraining, for such texture is generally due to local kinks and microcompressions in the fibers that may be relaxed when the tissue is wetted, causing the tissue to collapse toward a flatter state than it was in while dry.

Other methods are known in the art for protecting the strength of a paper web, such as when the paper web is wet. These methods, however, do little to protect the texture or added bulk of the web while maintaining web strength. For example, wet strength agents may be used in tissue and other paper webs to help strengthen or protect fiber-fiber bonds of the web as it dries, but such agents do not protect additional texture imparted to the dry web by embossing, creping, microstraining, or similar processes. When an embossed web which has been treated with wet strength agents is wetted, the swelling of the fibers and/or the relaxation of stresses in the fibers tends to remove much of the embossed texture as the web returns to the topography that existed as the web initially dried when the wet strength agents became activated or cured.

Thus, there is a need for a method of converting a dry tissue web or other porous web into a structure having enhanced texture and physical properties. Moreover, there is a need for a highly textured web which may maintain a high level of added bulk even after becoming wet.

Further, wet-resilient webs, such as those treated with a wet-strength agent, tend to have substantially uniform physical properties in the web. Physical properties of a paper web could be improved through a more heterogeneous structure. Thus, there is a further need for a high bulk fibrous web having heterogeneous physical properties and an improved method for producing such a heterogeneous web.

SUMMARY OF THE INVENTION

The present invention is directed to a process for printing an adhesive material onto a paper web. In general, the adhesive material may be printed onto a surface of a web with a low pressure printing process such that the web is not substantially densified by the printing process. For instance, the printing process may exert a peak printing pressure on the web of less than about 100 psi, more specifically between about 0.2 psi and about 30 psi, most specifically about 5 psi or less. For example, the low pressure printing process may be a flexographic printing process, an inkjet printing process, or a digital printing process.

The adhesive material may be applied to the web in any desired pattern, including, for example, a pattern that is heterogeneous across the surface of the web.

In one embodiment, the adhesive material may be printed on the web using a flexographic printing process wherein the printing nip is formed between two interdigitating rolls. In such an embodiment, the web may also be microstrained in the printing nip, if desired. In another alternative, the web may be flexographically printed with only a flexographic plate, and no backing or impression cylinder is utilized.

The adhesive material may be any suitable adhesive that may be applied to the web using the printing process. Examples include known hot melts, silicone adhesives, latex compounds, and other curable adhesives including structural adhesives (epoxies, urethanes, etc.), UV-curable adhesives, and the like. The adhesives may be non-pressure sensitive adhesives (non-PSA).

Conventional flexographic inks for printing on paper typically have low viscosity, such as a viscosity of about 2 poise or less measured with a Brookfield viscometer at 20 revolutions per minute, or about 1 poise at infinite shear as determined by Casson plot. More viscous inks are known for use on textiles, wherein the inks may have viscosities of about 10–65 poise at 20 RPM on a Brookfield viscometer and about 3 to 15 poise at infinite shear as determined by Casson plot. Higher viscosity inks and pastes have also been disclosed for flexographic printing on textiles, however, according to the present invention, adhesive material having still higher viscosities may be printed with flexographic means on an absorbent web.

For example, at the temperature of application, a hot melt applied to a tissue or airlaid web with flexographic means may have a viscosity measured at 20 rpm on a Brookfield viscometer of 20 poise (p) or greater, such as 30 p, 50 p, 100 p, 200 p, 500 p, 1,000 p, 5,000 p, 10,000 p, 20,000 p, or greater. At infinite shear as measured using a Casson plot, the apparent viscosity of the viscous adhesive of the present invention may be, for example, 300 p, 800 p, 3,000 p, 8,000 p, 15,000 p, or greater. The viscosity values may apply to the hotmelt at the pool temperature (the temperature of the hotmelt immediately before it is applied to the flexographic cylinder), or may refer to viscosities measured at 150° C. Alternatively, hot melt adhesives for use in the present invention may have a viscosity evaluated at 195° C. of 1 poise to 300 poise (100 cp to 30,000 cp), more specifically from about 10 poise to 200 poise, and most specifically from about 20 poise to about 100 poise.

At room temperature, the viscous adhesives may behave as a solid. The melting point of the viscous adhesive for use in the present invention may be, for example, 40° C., 60° C., 80° C., 100° C., 120° C., 150° C., 200° C., 250° C., 300° C., or greater. In certain embodiments, the melting point of the adhesive may be from about 40° C. to about 200° C., more specifically from about 60° C. to about 150° C., and most specifically from about 60° C. to about 120° C.

Suitable hotmelts may include, but are not limited to, EVA (ethylene vinyl acetate) hot melts (e.g. copolymers of EVA), polyolefin hotmelts, polyamide hotmelts, pressure sensitive hot melts, styrene-isoprene-styrene (SIS) copolymers, styrene-butadiene-styrene (SBS) copolymers, ethylene ethyl acrylate copolymers (EEA), polyurethane reactive (PUR) hotmelts, and the like. In one embodiment, poly(alkyloxazoline) hotmelt compounds may be used. If desired, the hotmelt may be water sensitive or water-remoistenable. This may be desirable, for example, in an embodiment wherein the applied hotmelt may be moistened and then joined to another surface to bond the printed web to the other surface.

If a latex or other adhesive material other than hotmelts is used, the viscosity as applied (prior to drying or curing) may be greater than 65 cp, specifically about 100 cp or greater, more specifically about 200 cp or greater, more specifically still about 250 cp or greater, such as from about 150 cp to about 500 cp, or from about 200 cp to about 1000 cp, or from about 260 cps to about 5000 cp. Solids content of a latex may be about 10% or greater, specifically about 25% or greater, more specifically about 35% or greater, and most specifically about 45% or greater.

If desired, the adhesive material may be printed on both sides of the paper web. Similarly, other additives may also be printed on either or both sides of the paper web. In one embodiment, a duplex flexographic system or other two-sided printing systems are used to print adhesive material onto both surfaces of the web.

In one embodiment, the process of the present invention includes forming a paper web, molding the paper web into a three dimensional state, printing an adhesive material onto the web, and curing the adhesive material. The adhesive material may be printed on the web by a low pressure printing process in a printing pattern such that, when it cures, the presence of the adhesive on the web may prevent the three dimensional state of the web from relaxing back into a more two dimensional orientation. Not all of the three-dimensional state need be retained, but the printed adhesive may be said to be effective in retaining the three-dimensional state if at least a portion of the three-dimensional state is retained. For example, if a web is molded into a state having molded peaks and valleys of about 1 mm in height, but a degree of relaxation occurs such that the added molded peaks and valleys after curing of the adhesive have a height of only about 0.4 mm, then about 40% of the three-dimensional state may be said to have been retained. The added adhesive may be effective in retaining a majority of the molded three-dimensional state or a smaller part thereof (e.g., at least about 20%). Alternatively, the added adhesive may be said to be effective in retaining a molded three-dimensional structure if structures of at least 0.1 mm in height are retained by the added adhesive relative to an otherwise identical process in which no adhesive is added.

In another embodiment, the paper web may be given an increased three-dimensional state by virtue of elevated regions of printed adhesive material on the surface of the web that rise above the underlying paper web by about 0.03 mm or greater.

The pressure applied to the web during printing may be optimized for the demands of the particular system. For example, low-pressure flexographic printing of isolated spots of adhesive material on a web may modify the texture of the web (particularly by the presence of elevated adhesive deposits on the web) without substantially altering its tensile strength. However, it has been discovered that the same pattern applied at a higher load may result in the adhesive material being driven more deeply into a porous web, and possibly bleeding away from the elevated print elements of the flexographic plate, such that the adhesive material in the web may join many fibers together and result in substantially increased tensile strength in the web. Penetration of the adhesive into the web, when desired, may also be achieved by control of viscosity and surface chemistry (lower viscosity may improve penetration, and adhesive material that more easily wets the web or flows into the pores of the web will generally result in improved penetration).

The order of the molding and printing in the process is not critical to the invention. For instance, the web may be printed with adhesive material and then molded, may be molded prior to being printed with adhesive, or the molding and the printing may be done at substantially the same time.

The web may be molded through any suitable process; for example, the web may be molded while the web is held against a molding substrate with applied pressure. In one embodiment, the web may be held against a molding substrate by a pneumatic force. For example, the web may be molded with a differential pressure across the web of between about 1 and about 200 kPa, more specifically between about 5 and about 150 kPa.

In one embodiment, the web is molded with a relatively low molding pressure such that the molding of the web does not cause significant deformation of the papermaking fibers.

The adhesive material may be printed onto the web in a printing pattern which, when cured, helps to lock the three-dimensional molded structure into the web. For example, the printing pattern may comprise at least a portion of the areas of major curvature of the raised web portions which are formed by the molding process. In one embodiment, the printing pattern may coincide with the base or lower elevation areas surrounding the raised web portions of the web.

The present invention is also directed to the paper products formed by the process. The paper products may include a paper web which has raised web portions projecting out of the surface of the web such that the web has a three dimensional structure. The web also has an adhesive material printed onto the web so as to prevent the raised web portions from relaxing back into the plane of the web.

In general, the web of the present invention may have a basis weight of between about 10 and about 200 gsm, specifically between about 15 and 120 gsm, more specifically between about 25 and 100 gsm, most specifically between about 30 an 90 gsm. The web may have a bulk greater than about 3 cc/g. More specifically, the web may have a bulk between about 3 and about 20 cc/g. The Frazier air permeability of the base web may generally be greater than about 10 cfm. In one embodiment, the paper web may be a stratified web.

The added texturing on the web may produce raised web portions having a height above the planar surface of the web of about 0.2 mm or greater, about 0.3 mm or greater, about 0.5 mm or greater, or about 0.7 mm or greater, such as from about 0.2 mm to about 1 mm, or from about 0.25 mm to about 0.7 mm.

DEFINITIONS AND TEST METHODS

As used herein, a material is said to be "absorbent" if it may retain an amount of water equal to at least 100% of its dry weight as measured by the test for Intrinsic Absorbent Capacity given below (i.e., the material has an Intrinsic Absorbent Capacity of about 1 or greater). For example, the absorbent materials used in the absorbent products of the present invention may have an Intrinsic Absorbent Capacity of about 2 or greater, more specifically about 4 or greater, more specifically still about 7 or greater, and more specifically still about 10 or greater, with exemplary ranges of from about 3 to about 30 or from about 4 to about 25 or from about 12 to about 40.

As used herein, "Intrinsic Absorbent Capacity" refers to the amount of water that a saturated sample may hold relative to the dry weight of the sample and is reported as a dimensionless number (mass divided by mass). The test is performed according to Federal Government Specification UU-T-595b. It is made by cutting a 10.16 cm long by 10.16 cm wide (4 inch long by 4 inch wide) test sample, weighing it, and then saturating it with water for three minutes by soaking. The sample is then removed from the water and hung by one corner for 30 seconds to allow excess water to be drained off. The sample is then re-weighed, and the difference between the wet and dry weights is the water pickup of the sample expressed in grams per 10.16 cm long by 10.16 cm wide sample. The Intrinsic Absorbent Capacity value is obtained by dividing the total water pick-up by the dry weight of the sample. If the material lacks adequate integrity when wet to perform the test without sample disintegration, the test method may be modified to provide improved integrity to the sample without substantially modifying its absorbent properties. Specifically, the material may be reinforced with up to 6 lines of hot melt adhesive having a diameter of about 1 mm applied to the outer surface of the article to encircle the material with a water-resistant band. The hot melt should be applied to avoid penetration of the adhesive into the body of the material being tested. The corner on which the sample is hung in particular should be reinforced with external hot melt adhesive to increase integrity if the untreated sample cannot be hung for 30 seconds when wet.

As used herein, a material is said to be "deformable" if the thickness of the material between parallel platens at a compressive load of 100 kPa is at least 5% greater than the thickness of the material between parallel platens at a compressive load of 1000 kPa.

"Water retention value" (WRV) is a measure that may be used to characterize some fibers useful for purposes of this invention. WRV is measured by dispersing 0.5 grams of fibers in deionized water, soaking overnight, then centrifuging the fibers in a 4.83 cm (1.9 inch) diameter tube with an 0.15 mm (100 mesh) screen at the bottom at 1000 gravities for 20 minutes. The samples are weighed, then dried at 105° C. for two hours and then weighed again. WRV is (wet weight-dry weight)/dry weight. Fibers useful for purposes of this invention may have a WRV of about 0.7 or greater, more specifically from about 1 to about 2. High yield pulp fibers typically have a WRV of about 1 or greater.

As used herein, the "wet:dry ratio" is the ratio of the mean cross-directional wet tensile strength divided by the mean cross-directional dry tensile strength. The absorbent webs used in the present invention may have a wet:dry ratio of about 0.1 or greater and more specifically about 0.2 or greater. Tensile strength in the cross-direction or machine direction may be measured using an Instron tensile tester using a 3-inch jaw width (sample width), a jaw span of 2 inches (gauge length), and a crosshead speed of 25.4 centimeters per minute after maintaining the sample under TAPPI conditions for 4 hours before testing.

Unless otherwise indicated, the term "tensile strength" as used herein means "geometric mean tensile strength" (note that wet tensile strength is generally measured in the cross-direction). Geometric mean tensile strength (GMT) is the square root of the product of the machine direction tensile strength and the cross-machine direction tensile strength of the web. The absorbent webs of the present invention may have a minimum absolute ratio of dry tensile strength to basis weight of about 0.01 gram/gsm, specifically about 0.05 grams/gsm, more specifically about 0.2 grams/gsm, more specifically still about 1 gram/gsm and most specifically from about 2 grams/gsm to about 50 grams/gsm.

As used herein, "bulk" and "density," unless otherwise specified, are based on an oven-dry mass of a sample and a thickness measurement made at a load of 0.34 kPa (0.05 psi) with a 7.62-cm (three-inch) diameter circular platen made under TAPPI conditions (73° F., 50% relative humidity) after four hours of sample conditioning. A stack of five sheets is used.

The sheets rest beneath the flat platen and above a flat surface parallel to the platen. The platen is connected to a thickness gauge such as a Mitutoyo digital gauge which senses the displacement of the platen caused by the presence of the sheets. Samples should be essentially flat and uniform under the contacting platen. The measured thickness of the stack is divided by the number of sheets to get the thickness per sheet. The macroscopic thickness measurement made in this manner gives an overall thickness of the sheet for use in calculating the "bulk" of the web. Bulk is calculated by dividing the thickness of five sheets by the basis weight of the five sheets (conditioned mass of the stack of five sheets divided by the area occupied by the stack which is the area of a single sheet). Bulk is expressed as volume per unit mass in cc/g and density is the inverse, g/cc.

As used herein, "local thickness" refers to the distance between the two opposing surfaces of a web along a line substantially normal to both surfaces. The measurement is a reflection of the actual thickness of the web at a particular location, as opposed to the micro-caliper.

"Brookfield viscosity" may be measured with a Brookfield Digital Rheometer Movel DV-III with a Brookfield Temperature Controller using Spindle #27.

A measure of the permeability of a fabric or web to air is the "Frazier Permeability" which is performed according to Federal Test Standard 191A, Method 5450, dated Jul. 20, 1978, and is reported as an average of 3 sample readings. Frazier Permeability measures the airflow rate through a web in cubic feet of air per square foot of web per minute or CFM.

A three-dimensional basesheet or web is a sheet with significant variation in surface elevation due to the intrinsic structure of the sheet itself. As used herein, this elevation difference is expressed as the "Surface Depth" which is the characteristic peak-to-valley depth of the surface, as measured by a non-compressive optical means such as CADEYES moiré interferometry (described more fully hereafter) that measures surface elevation over an approximately 38-mm square area with an x-y pixel density of about 500 by 500 pixels. For example, a creped surface with repeating crepe folds ranging from 30 to 60 microns in height (as measured with moiré interferometry) will have a surface depth of about 60 microns (peaks are excluded that occur due to obvious surface defects, optical noise, etc., to ensure that the measurement is representative of the sample). A molded tissue web with repeating unit cell structures having up to 150 microns in elevating difference across the unit cell will have a Surface Depth of about 150 microns CADEYES Surface Topography Measurements A suitable method for measurement of Surface Depth is moiré interferometry which permits accurate measurement without deformation of the surface of the tissue webs. For reference to the tissue webs of the present invention, the surface topography of the tissue webs should be measured using a computer-controlled white-light field-shifted moiré interferometer with about a 38 mm field of view. A suitable commercial instrument for moiré interferometry is the CADEYES® interferometer produced by Integral Vision (Farmington Hills, Mich.), constructed for a 38-mm field-of-view (a field of view within the range of 37 to 39.5 mm is adequate). The CADEYES® system uses white light which is projected through a grid to project fine black lines onto the sample surface. The surface is viewed through a similar grid, creating moiré fringes that are viewed by a CCD camera. Suitable lenses and a stepper motor adjust the optical configuration for field shifting. A video processor sends captured fringe images to a PC computer for processing, allowing details of surface height to be back calculated from the fringe patterns viewed by the video camera.

The computerized CADEYES® interferometer system is used to acquire topographical data and then to generate a grayscale image of the topographical data, said image to be hereinafter called "the height map". The height map is displayed on a computer monitor, typically in 256 shades of gray and is quantitatively based on the topographical data obtained for the sample being measured. The resulting height map for a 38-mm square measurement area should contain approximately 250,000 data points corresponding to approximately 500 pixels in both the horizontal and vertical directions of the displayed height map. The pixel dimensions of the height map are based on a 512×512 CCD camera which provides images of moiré patterns on the sample which may be analyzed by computer software. Each pixel in the height map represents a height measurement at the corresponding x- and y-location on the sample. In the recommended system, each pixel has a width of approximately 70 microns, i.e. represents a region on the sample surface about 70 microns long in both orthogonal in-plane directions). This level of resolution prevents single fibers projecting above the surface from having a significant effect on the surface height measurement. The z-direction height measurement must have a nominal accuracy of less than 2 microns and a z-direction range of at least 1.5 mm.

The moiré interferometer system, once installed and factory calibrated to provide the accuracy and z-direction range stated above, may provide accurate topographical data for materials such as paper towels. (Those skilled in the art may confirm the accuracy of factory calibration by performing measurements on surfaces with known dimensions). Tests are performed in a room under Tappi conditions (23° C., 50% relative humidity). The sample must be placed flat on a surface lying aligned or nearly aligned with the measurement plane of the instrument and should be at such a height that both the lowest and highest regions of interest are within the measurement region of the instrument.

When a surface is translucent or transparent, measurements may be subject to high optical noise. In such cases, it is helpful to make a putty impression of the surface and then measure the topography of the putty impression. For several measurements pertaining to the present invention, putty impressions were made using 65 grams of coral-colored Dow Corning 3179 Dilatant Compound (believed to be the original "Silly Putty®" material) in a conditioned room at 23° C. and 50% relative humidity. The Dilatant Compound was rendered more opaque for better results with moiré interferometry by the addition of 0.8 g of white solids applied by painting white Pentel® (Torrance, Calif.) Correction Pen fluid (purchased in 1997) on portions of the putty, allowing the fluid to dry, and then blending the painted portions to uniformly disperse the white solids (believed to be primarily titanium dioxide) throughout the putty. This action was repeated approximately a dozen times until a mass increase of 0.8 grams was obtained. A portion of putty was rolled into a flat, smooth disk about 3 cm in diameter and about 0.5 cm in thickness which was placed over flexographically printed simples and pressed to mold the putty with the impression of the flexographically printed material. The molded side of the putty was turned face up and placed under a 5-mm field-of-view optical head of the Cadeyes® device for measurement.

The height of valleys and peaks may be determined by examining representative profile lines along the height map obtained with the CADEYES system, as illustrated in the Examples. Details of measuring surface structures with the CADEYES system are also disclosed and illustrated in U.S. Pat. No. 6,395,957, "Dual-Zoned Absorbent Webs," issued May 28, 2002 to Chen et al., herein incorporated by reference.

Surface Depth is intended to examine the topography produced in the base sheet, especially those features created in the sheet prior to and during drying processes and structures added by printing operations according to the present invention, but is intended to exclude "artificially" created large-scale topography from other dry converting operations such as embossing, perforating, pleating, etc. Therefore, the profiles examined should be taken from unembossed, unperforated, unfolded regions. It is recognized that sheet topography may be reduced by calendering and other operations which affect the entire base sheet. Surface Depth measurement may be appropriately performed on a calendared base sheet.

In general, printing adhesive material by a flexographic process or related means according to the present invention may add adhesive deposits that rise above the surface of the web by (or, alternatively, that increase the Surface Depth of the web by) about any of the following: 0.03 mm or greater, 0.04 mm or greater, 0.05 mm or greater, 0.06 mm or greater, 0.07 mm or greater, 0.08 mm or greater, 0.1 mm or greater, 0.15 mm or greater, 0.2 mm or greater, 0.3 mm or greater, and 0.4 mm or greater, such as from about 0.04 mm to about 0.4 mm, or from about 0.07 mm to about 0.3 mm. The CADEYES system may be used to determine the height of a printed adhesive structure relative to the surrounding web.

BRIEF DESCRIPTION OF THE FIGURES

A full and enabling disclosure of the present invention, including the best mode thereof to one of ordinary skill in the art, is set forth more particularly in the remainder of the specification, including reference to the accompanying figures in which:

FIG. 15 provides a table of experimental data.

Figure 1:
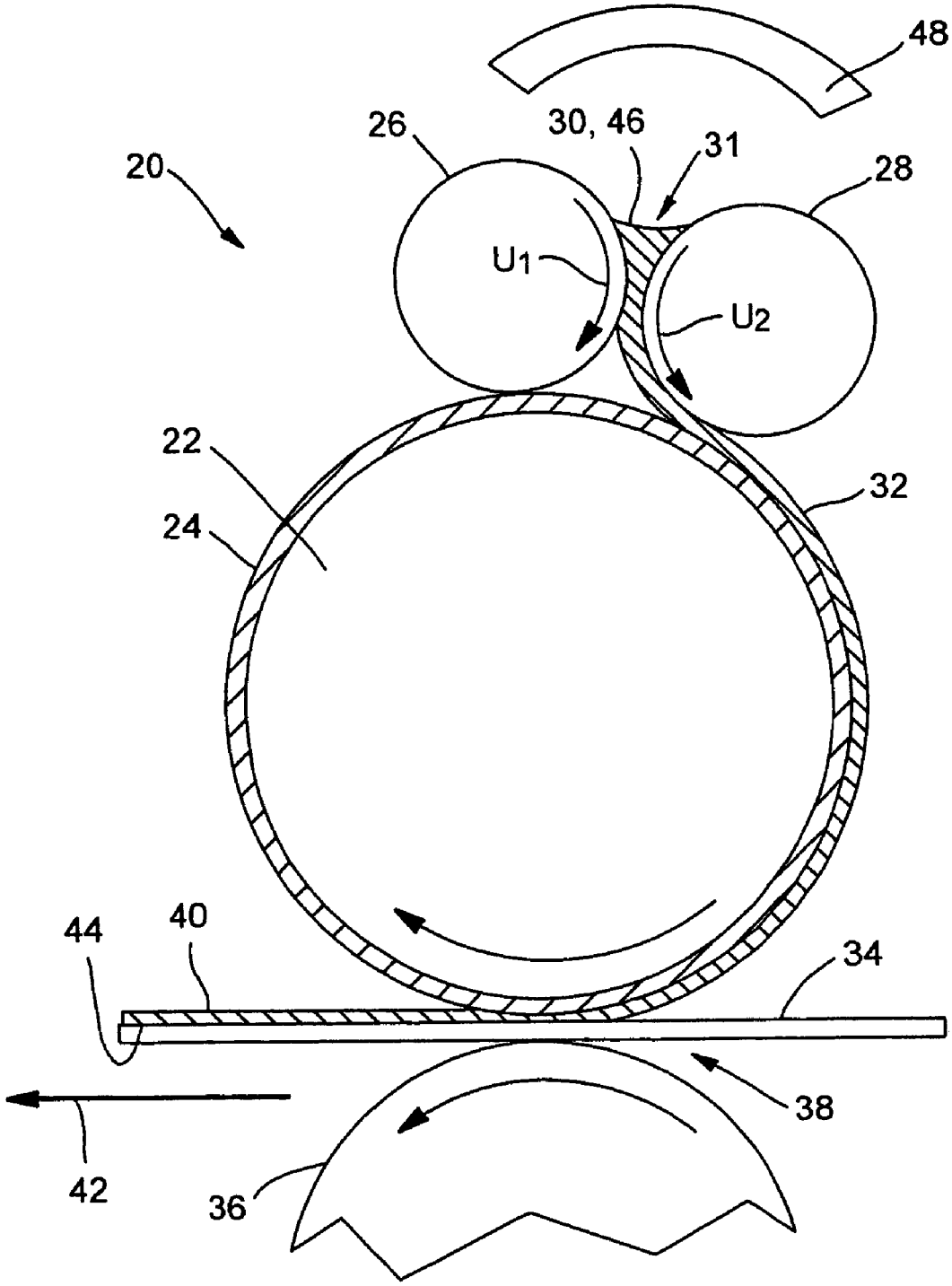
FIG. 1 depicts one embodiment of a flexographic printing apparatus suitable for use in the process of the present invention.

Repeat use of reference characters in the present specification and drawings is intended to represent same or analogous features or elements of the present invention.

DETAILED DESCRIPTION OF PREFERRED EMBODIMENTS

Reference now will be made in detail to embodiments of the invention, one or more examples of which are set forth below. Each example is provided by way of explanation of the invention, not limitation of the invention. In fact, it will be apparent to those skilled in the art that various modifications and variations may be made in the present invention without departing from the scope or spirit of the invention. For instance, features illustrated or described as part of one embodiment, may be used on another embodiment to yield a still further embodiment. Thus, it is intended that the present invention cover such modifications and variations as come within the scope of the appended claims and their equivalents.

The present invention is generally directed to a process for producing an improved high bulk paper web and the high bulk webs produced by the process. The process of the present invention provides a method for 'locking in' three dimensional texturing added to a web by virtue of an adhesive material which is printed onto the surface of the web. Specifically, it has been discovered that certain printing technologies may be used to deliver a binder or adhesive material to the surface of a paper web such as a tissue, an air laid web, or a fibrous nonwoven web. The adhesive may be applied to the web either before, during or after the web is molded to increase the surface texture of the web. The adhesive material may then be finally cured (i.e., dried or otherwise set).

The pattern of the adhesive on the web is such that the cured adhesive may lock in and maintain the added three dimensional structure of the web and may prevent the textured web from relaxing back into a more two dimensional orientation. If desired, the pattern of the adhesive material may be designed to be heterogeneous across the face of the web, such that there are macroscopic regions of the web that are printed with different patterns and/or amounts of the adhesive material. Such macroscopic patterns may be designed to further enhance the web characteristics, such as through enhanced tactile and/or strength characteristics.

In various embodiments, the present invention may produce paper web products with increased bulk when both wet and dry. The present process may also increase the wet resiliency, the wet strength and improve the tactile properties of the paper products. In one embodiment, the treated web may maintain high bulk even when wet and under a compressive load, whereas without the applied adhesive material, the molded web would be relatively flatter and would have a lower bulk, particularly when under load and wet.

Generally, the molding process used in conjunction with the added adhesive material may be any known molding process suitable for a paper web. In one embodiment, the molding process may be a high pressure molding process such as an embossing process. Alternatively, the molding process may be a low pressure molding process. That is, the molding process may be one which does not create significant kinks or fiber damage through application of high pressure concentrated in local regions causing mechanical deformation of fibers, as is the case for conventional embossing. Rather, the web may be molded with low applied pressure, e.g., less than 100 psi, less than 50 psi, less than 10 psi, less than 5 psi, less than 2 psi, such as from about 0.1 psi to 20 psi, or from about 0.5 psi to about 10 psi, the pressure being adequate to arrange the web into a three-dimensional state that ordinarily would not remain in the web to a significant degree were it not for the application of an adhesive material which may lock in the applied three-dimensional shape of the web.

Though the web may also be subjected to other molding techniques, such as known embossing techniques, for example, either before or after the three-dimensional structuring of the present invention, this is not a requirement. For example, in one embodiment, a high bulk paper web product may be produced wherein the web is not mechanically embossed at all (i.e., the fibers are not damaged with kinks to provide the additional three-dimensional texture).

Base webs that may be used in the process of the present invention may vary depending upon the particular application. In general, any suitable base web may be used in the process in order to improve the characteristics of the web. Further, the webs may be made from any suitable type of papermaking fibers.

"Papermaking fibers," as used herein, include all known cellulosic fibers or fiber mixes comprising cellulosic fibers. As used herein, the term "cellulosic" is meant to include any material having cellulose as a major constituent, and specifically comprising at least 50 percent by weight cellulose or a cellulose derivative. Thus, the term includes cotton, typical wood pulps, nonwoody cellulosic fibers, cellulose acetate, cellulose triacetate, rayon, thermomechanical wood pulp, chemical wood pulp, debonded chemical wood pulp, milkweed, or bacterial cellulose.

Fibers suitable for making the webs of this invention may include any natural or synthetic cellulosic fibers including, but not limited to nonwoody fibers, such as cotton, abaca, kenaf, sabai grass, flax, esparto grass, straw, jute hemp, bagasse, milkweed floss fibers, and pineapple leaf fibers; and woody fibers such as those obtained from deciduous and coniferous trees, including softwood fibers, such as northern and southern softwood kraft fibers; hardwood fibers, such as eucalyptus, maple, birch, and aspen. Woody fibers may be prepared in high-yield or low-yield forms and may be pulped in any known method, including kraft, sulfite, high-yield pulping methods and other known pulping methods. Fibers prepared from organosolv pulping methods may also be used. Useful fibers may also be produced by anthraquinone pulping. A portion of the fibers, such as up to 50% or less by dry weight, or from about 5% to about 30% by dry weight, may be synthetic fibers such as rayon, polyolefin fibers, polyester fibers, bicomponent sheath-core fibers, and the like. An exemplary polyethylene fiber is Pulpex®, available from Hercules, Inc. (Wilmington, Del.).

Synthetic cellulose fiber types include rayon in all its varieties and other fibers derived from viscose or chemically modified cellulose. Chemically treated natural cellulosic fibers may be used such as mercerized pulps, chemically stiffened or crosslinked fibers, or sulfonated fibers. For good mechanical properties in using papermaking fibers, it may be desirable that the fibers be relatively undamaged and largely unrefined or only lightly refined. While recycled fibers may be used, virgin fibers are generally useful for their mechanical properties and lack of contaminants. Mercerized fibers, regenerated cellulosic fibers, cellulose produced by microbes, rayon, and other cellulosic material or cellulosic derivatives may be used. Suitable papermaking fibers may also include recycled fibers, virgin fibers, or mixes thereof. In certain embodiments capable of high bulk and good compressive properties, the fibers may have a Canadian Standard Freeness of at least 200, more specifically at least 300, more specifically still at least 400, and most specifically at least 500.

As used herein, "high yield pulp fibers" are those papermaking fibers of pulps produced by pulping processes providing a yield of about 65 percent or greater, more specifically about 75 percent or greater, and still more specifically from about 75 to about 95 percent. Yield is the resulting amount of processed fiber expressed as a percentage of the initial wood mass. High yield pulps include bleached chemithermomechanical pulp (BCTMP), chemithermomechanical pulp (CTMP), pressure/pressure thermomechanical pulp (PTMP), thermomechanical pulp (TMP), thermomechanical chemical pulp (TMCP), high yield sulfite pulps, and high yield Kraft pulps, all of which contain fibers having high levels of lignin. Characteristic high-yield fibers may have lignin content by mass of about 1% or greater, more specifically about 3% or greater, and still more specifically from about 2% to about 25%. Likewise, high yield fibers may have a kappa number greater than 20, for example. In one embodiment, the high-yield fibers are predominately softwood, such as northern softwood or, more specifically, northern softwood BCTMP. The amount of high-yield pulp fibers present in the sheet may vary depending upon the particular application. For instance, the high-yield pulp fibers may be present in an amount of about 5 dry weight percent or greater, or specifically, about 15 dry weight percent or greater, and still more specifically from about 15 to about 30%. In other embodiments, the percentage of high-yield fibers in the web may be greater than any of the following: about 30%, about 50%, about 60%, about 70%, and about 90%. For example, the web may comprise about 100% high-yield fibers.

In one embodiment, the web may be a multi-ply paper web product. For example, a laminate of two or more tissue layers or a laminate of an airlaid web and a wetlaid tissue may be formed using adhesives or other means known in the art.

The paper web of the present invention may optionally be formed with other known paper making additives which may be utilized to improve the web characteristics. For example, paper webs formed with surfactants, softening agents, permanent and/or temporary wet strength agents, or dry strength agents are all suitable for use in the present inventive process.

As used herein, the term "surfactant" includes a single surfactant or a mixture of two or more surfactants. If a mixture of two or more surfactants is employed, the surfactants may be selected from the same or different classes, provided only that the surfactants present in the mixture are compatible with each other. In general, the surfactant may be any surfactant known to those having ordinary skill in the art, including anionic, cationic, nonionic and amphoteric surfactants. Examples of anionic surfactants include, among others, linear and branched-chain sodium alkylbenzenesulfonates; linear and branched-chain alkyl sulfates; linear and branched-chain alkyl ethoxy sulfates; and silicone phosphate esters, silicone sulfates, and silicone carboxylates such as those manufactured by Lambent Technologies, located in Norcross, Ga. Cationic surfactants include, by way of illustration, tallow trimethylammonium chloride and, more generally, silicone amides, silicone amido quaternary amines, and silicone imidazoline quaternary amines. Examples of nonionic surfactants, include, again by way of illustration only, alkyl polyethoxylates; polyethoxylated alkylphenols; fatty acid ethanol amides; dimethicone copolyol esters, dimethiconol esters, and dimethicone copolyols such as those manufactured by Lambent Technologies; and complex polymers of ethylene oxide, propylene oxide, and alcohols. One exemplary class of amphoteric surfactants is the silicone amphoterics manufactured by Lambent Technologies (Norcross, Ga).

Softening agents, sometimes referred to as debonders, may be used in the present invention to enhance the softness of the tissue product. Softening agents may be incorporated with the fibers before, during or after disperging. Such agents may also be sprayed, printed, or coated onto the web after formation, while wet, or added to the wet end of the tissue machine prior to formation. Suitable agents include, without limitation, fatty acids, waxes, quaternary ammonium salts, dimethyl dihydrogenated tallow ammonium chloride, quaternary ammonium methyl sulfate, carboxylated polyethylene, cocamide diethanol amine, coco betaine, sodium lauryl sarcosinate, partly ethoxylated quaternary ammonium salt, distearyl dimethyl ammonium chloride, polysiloxanes and the like. Examples of suitable commercially available chemical softening agents include, without limitation, Berocell 596 and 584 (quaternary ammonium compounds) manufactured by Eka Nobel Inc., Adogen 442 (dimethyl dihydrogenated tallow ammonium chloride) manufactured by Sherex Chemical Company, Quasoft 203 (quaternary ammonium salt) manufactured by Quaker Chemical Company, and Arquad 2HT-75 (dihydrogenated tallow) dimethyl ammonium chloride) manufactured by Akzo Chemical Company. Suitable amounts of softening agents will vary greatly with the species selected and the desired results. Such amounts may be, without limitation, from about 0.05 to about 1 weight percent based on the weight of fiber, more specifically from about 0.25 to about 0.75 weight percent, and still more specifically about 0.5 weight percent.

Typically, the means by which fibers are held together in paper and tissue products involve hydrogen bonds and sometimes combinations of hydrogen bonds and covalent and/or ionic bonds. In the present invention, it may be useful to provide a material that will allow bonding of fibers in such a way as to immobilize the fiber-to-fiber bond points and make them resistant to disruption in the wet state. In this instance, the wet state usually will mean when the product is largely saturated with water or other aqueous solutions, but could also mean significant saturation with body fluids such as urine, blood, mucus, menses, runny bowel movement, lymph and other body exudates.

There are a number of materials commonly used in the paper industry to impart wet strength to paper and board that are applicable to this invention. These materials are known in the art as "wet strength agents" and are commercially available from a wide variety of sources. Any material that when added to a paper web or sheet results in providing the sheet with a mean cross-directional wet tensile strength:dry cross-directional tensile strength ratio in excess of 0.1 will, for purposes of this invention, be termed a wet strength agent. Typically these materials are termed either as permanent wet strength agents or as "temporary" wet strength agents. For the purposes of differentiating permanent from temporary wet strength, permanent will be defined as those resins which, when incorporated into paper or tissue products, will provide a product that retains more than 50% of its original wet strength after exposure to water for a period of at least five minutes. Temporary wet strength agents are those which show less than 50% of their original wet strength after being saturated with water for five minutes. Both classes of material find application in the present invention. The amount of wet strength agent added to the pulp fibers may be at least about 0.1 dry weight percent, more specifically about 0.2 dry weight percent or greater, and still more specifically from about 0.1 to about 3 dry weight percent, based on the dry weight of the fibers.

Permanent wet strength agents will provide a more or less long-term wet strength to the product. n contrast, the temporary wet strength agents would provide products that had low density and high resilience, but would not provide a product that had long-term resistance to exposure to water or body fluids. The mechanism by which the wet strength is generated has little influence on the products of this invention as long as the essential property of generating water-resistant bonding at the fiber/fiber bond points is obtained.

Suitable permanent wet strength agents are typically water soluble, cationic oligomeric or polymeric resins that are capable of either crosslinking with themselves (homocrosslinking) or with the cellulose or other constituent of the wood fiber. The most widely used materials for this purpose are the class of polymer known as polyamide-polyamine-epichlorohydrin type resins.

With respect to the classes and the types of wet strength resins listed, it should be understood that this listing is simply to provide examples and that this is neither meant to exclude other types of wet strength resins, nor is it meant to limit the scope of this invention.

Although wet strength agents as described may be used in connection with this invention, other types of bonding agents may also be used to provide wet resiliency. They may be applied at the wet end of the basesheet manufacturing process or applied by spraying or printing after the basesheet is formed or after it is dried.

The manner in which the base web of the present invention is formed may also vary depending upon the particular application. For example, the web may contain pulp fibers and may be formed in a wet-lay process according to conventional paper making techniques. In a wet-lay process, the fiber furnish is combined with water to form an aqueous suspension. The aqueous suspension is spread onto a wire or felt and dried to form the web.

In one embodiment, the web may be formed from an aqueous suspension of fibers, as is known in the art, and then pressed onto the surface of a rotatable heated dryer drum, such as a Yankee dryer, by a press roll. As the web is carried through a portion of the rotational path of the dryer surface, heat is imparted to the web causing most of the moisture contained within the web to be evaporated. The web is then removed from the dryer drum by a creping blade. Creping the web as it is formed reduces internal bonding within the web and increases softness.

In an alternative-embodiment, instead of wet pressing the base web onto a dryer drum and creping the web, the web may be through-air dried. A through-air dryer accomplishes the removal of moisture from the base web by passing air through the web without applying any mechanical pressure.

Alternatively, the base web of the present invention may be air formed. In this embodiment, air is used to transport the fibers and form a web. Air-forming processes are typically capable of processing longer fibers than most wet-lay processes which may provide an advantage in some applications.

The process of the present invention is generally applicable for any formable base web. In one embodiment, the base web may have a basis weight between about 10 and about 80 gsm. Additionally, the base web may be fairly porous and may have a Frazier air permeability of greater than about 10 cfm. Moreover, the base webs of the present invention may be absorbent base webs, with an Intrinsic Absorbent Capacity of greater than about 2 g $H_2O$/g. More specifically, webs suitable for processing according to the present invention may have an Intrinsic Absorbent Capacity of greater than about 5 g $H_2O$/g.

The initial bulk of the base web, prior to the molding process of the present invention may be great or small, as desired. For example, in one embodiment, the base web, prior to the molding process of the present invention may be a relatively low bulk base web, with a bulk of less than 10 cc/g and a Surface Depth of less than about 0.2 mm, more particularly less than about 0.1 mm. For example, the base web may have a bulk of between about 3 and about 10 cc/g, more specifically between about 5 and about 10 cc/g. In an alternative embodiment, the base web may already be a relatively high bulk web, prior to subjection to the process of the present invention. For example, the base web may have a bulk between about 10 cc/g and about 20 cc/g. In such an embodiment, wherein the base web already has a relatively high bulk, the process of the present invention may not add a great deal of bulk to the web, but may primarily be utilized to enhance other characteristics of the web, such as tactile, strength and wet resiliency characteristics, for example.

If desired, the base web may be formed from multiple layers of a fiber furnish. Both strength and softness may be achieved through layered webs, such as those produced from stratified headboxes. In one embodiment, at least one layer delivered by the headbox comprises softwood fibers while another layer comprises hardwood or other fiber types. Layered structures produced by any means known in the art are within the scope of the present invention. For example, in one embodiment, a paper web with high internal bulk and good integrity of the surfaces may be formed which may include a small portion of synthetic binder fibers present in the web, and the web may have a layered structure with a weak or debonded middle layer and relatively stronger outer layers. For example, outer layers may comprise refined softwood for strength, and the middle layer may comprise over 30% high-yield fibers such as CTMP that have been treated with a debonder. In addition, long synthetic binder fibers, such as bicomponent sheath-core fibers, may be used. In one embodiment, some of the fibers may extend across the middle layer to provide z-direction strength to the web.

In one embodiment, high bulk may be imparted to the web by the use of bicomponent fibers that curl when heated. This may be especially useful in a middle layer, though fibers that curl when heated could be added anywhere to the web.

In accordance with the present invention, any of a variety of low pressure printing technologies may be utilized to print an adhesive material onto a paper web. In the present disclosure, low pressure printing technologies are generally considered to be those in which the peak pressure applied to the web during the printing process is such that will not substantially densify the web. Exemplary peak pressures may be any of the following: about 100 psi or less, about 50 psi or less, about 20 psi or less, about 10 psi or less, about 5 psi or less, about 2 psi or less, about 1 psi or less, and about 0.8 psi or less. The same ranges may be applied to the mean pressure on the web during contact with a printing device.

In general, the adhesive material may be printed onto the web to form a pattern. The printing pattern generally includes areas of the surface of the web which are substantially free of the adhesive material. In conjunction with printing the adhesive material, the web may be deformed through a molding process into a more three dimensional orientation which includes raised web portions that project out of the plane of the web. The presence of the cured adhesive material around or near the raised web portions formed into the web by a molding process may give the textured web a degree of resiliency against collapse when wet as well as when placed under a load. In other words, the raised web portions are less likely to relax back into the plane of the web due to the presence of the cured adhesive material which has been printed on the web.

The raised web portions molded into the web may be formed by any method and may have any desired shape. For example, the raised web portions, as viewed from above the surface of the web, may be substantially circular, oval, elongated, polygonal, bow-shaped, bone-shaped, arc-shaped, and the like. The web may be molded while the web is being dried, such as during a through-air drying process or alternatively may be molded in a separate step, after the web is substantially dry.

In general, the pattern of raised web portions molded into the web may be a repeating pattern of multiple raised web portions. For example, in one embodiment, a single repeating pattern of raised web portions may substantially cover the surface of the web. Alternatively, a single repeating pattern of raised web portions may be confined to certain discreet sections of the web surface. For example, the web surface may include areas including a repeating pattern of raised web portions and other substantially flat areas. Additionally, the surface of the web may include different areas of the web which are covered by different patterns of raised web portions, such that the web has heterogeneous patterns distributed across the web surface.

The cross sectional shape of the raised web portions may generally be sinusoidal, but this is not a requirement of the present invention. In general, the raised web portions may have a height above the planar surface of the web of about 0.2 mm or greater, about 0.3 mm or greater, about 0.5 mm or greater, or about 0.7 mm or greater, such as from about 0.2 mm to about 1 mm, or from about 0.25 mm to about 0.7 mm. Moreover, the distance from one raised web portion to an adjacent raised web portion within a repeating pattern may generally be less than about 20 mm. In one embodiment, the distance from one raised web portion to an adjacent one within a repeating pattern may be less than about 15 mm, such as, for example, between about 0.5 mm and about 10 mm. For purposes of this disclosure, the distance from one raised web portion to an adjacent raised web portion is defined to be the straight line distance between points of maximum height above the planar surface for adjacent raised web portions within a repeating pattern.

In one embodiment, the web may be molded with a relatively low applied pressure, such that, if not for the presence of the adhesive material on the web, the texture provided to the web by the molding process would not remain to any significant degree. For example, in one embodiment the web may be molded with a low-pressure force, such as a relatively low mechanical or pneumatic force, deforming the web against a molding substrate to assume the desired three-dimensional shape. Alternatively, however, the web may be molded with higher applied pressure, such as pressures encountered during embossing processes.

The molding substrate may be one which may provide any desired shape to the web. In one embodiment, the molding substrate may be a textured fabric which may carry the web. For example, a sculpted nonwoven fabric or any of the highly textured through-drying fabrics of Lindsay Wire division of Voith Fabrics (Appleton, Wis.) may be used as the molding substrate in the present invention.

Alternatively, the molding substrate may be, for example, a textured metal screen such as those used to receive comminuted fibers in the production of airfelt, a porous contoured substrate, or a solid contoured surface against which a deformable absorbent web may be mechanically pressed to impart the desired three-dimensional structure.

If desired, pneumatic forces may be used to mold the web against a porous molding substrate to form the desired three-dimensional structure. In such embodiments, steam, air, combustion gases, or other suitable gases may flow against the web to provide the desired level of pressure. Generally, the differential pressure across the web may be about 1 kPa or greater. For example, at least any of the following: 3 kPa or greater, 6 kPa, 10 kPa, 20 kPa, 50 kPa, 100 kPa, or 200 kPa, with an exemplary range of from about 1.5 kPa to about 50 KPa, or from about 5 kPa to about 150 kPa may provide a suitable molding pressure against the web. Gas temperatures may be about room temperature or greater, such as from about 50° C. to about 400° C., more specifically from about 80° C. to about 300° C., and most specifically from about 150° C. to about 240° C. Heated gas may be useful in those embodiments when the web also comprises thermoplastic binder fibers to further strengthen the web and further enhance the molding of the web.

As previously stated, an adhesive material may be applied to the web either before, during, or after the web is molded into the desired three-dimensional state. For example, in one embodiment, the web may be molded into the desired three-dimensional state and then, either while the web is held in the textured state or alternatively prior to the web relaxing out of the textured state, the adhesive material may be printed onto the web in the desired pattern. Alternatively, the adhesive may be printed on to the web in a pattern and then the web may be molded against a three dimensional substrate before the adhesive material finally cures. For example, in one embodiment, the adhesive may be printed on the web, and then the web may be pressed against a molding substrate such as with a pneumatic force. In such an embodiment, the molding process may additionally serve to cure the adhesive material with the gas or airflow which is pressing the web against the mold. Alternatively, the web may be molded and the adhesive may be applied to the web at the same time.

Curing of the adhesive may begin before, during, or after the web is deformed to assume a more three-dimensional shape, and completion of curing may occur either while the web is in contact with a molding substrate or alternatively after the web has been removed from a molding substrate but in any case before the web may relax out of the three dimensional state.

The adhesive may generally be applied to the web in a printing pattern with any low pressure printing methodology. In general, at least a portion of the adhesive material may overlap some of the areas of major curvature, as measured in the z-direction of the web, of the raised web portions which are molded into the base web. The presence of the adhesive material may thus help to 'lock in' the texture created by the molding process. For example, the adhesive pattern may partially overlap or may even coincide completely with areas of the web which define the top or alternatively the base areas of the raised web portions. For instance, in one embodiment the adhesive may be applied to the web in a pattern which substantially corresponds to the low elevation areas of the three-dimensional state that is molded into the web.

In one embodiment, the adhesive may be applied to the web through a flexographic printing process. It has been discovered that flexographic printing of adhesive materials useful in the present invention may provide excellent control of the amount of applied adhesive material while applying relatively little pressure to the web being printed.

Any known commercial flexographic equipment may be used, though in some embodiments it may be necessary to be adapted for the present invention. For example, equipment may be provided by Fulflex Inc., (Middletown, R.I.). In one embodiment, Fulflex's real time digital direct-to-plate laser engraving system (Direct Digital Flexo or DDF) may be used to prepare the flexographic plate. Fullflex Laserflex® image transfer materials may also be applied.

Generally, the web will be dry (e.g., about 92% solids or greater), but printing on a moist web is not necessarily outside the scope of the present invention. For example, the web may have a moisture content of 5% or greater, 10% or greater, or 20% or greater, such as from about 5% to 50%, or from 10% to 25%.

FIG. 1 depicts one possible embodiment of a flexographic printing apparatus 20 suitable for printing an adhesive material 30 on to an absorbent web 34 according to the processes of the present invention. As may be seen, the plate cylinder 22 may be covered with a flexographic plate 24 which may be engraved or otherwise textured (not shown) with a pattern of raised elements. The flexographic plate 24 typically comprises an elastomeric material, though this is not a requirement of the present invention. For example, the flexographic technology may use rubber rolls, if desired, including those formed of photocured rubber resins, polyesters, or other polymers known in the art, including EPDM nitrile, nitrile PVC, carboxylated nitrile, hydrogenated nitrile, Hypalon, and silicone elastomers.

In a flooded nip 31 between an applicator roll 28 and a counter-rotating roll 26 (typically a rubber roll or doctor roll), a pool 46 of an adhesive material 30 is maintained. Either or both of the rolls 26, 28 may be internally heated. An infrared heater or other heat source 48 may also be applied to control the temperature of the pool 46 of adhesive material 30, and thus control the viscosity. The counter-rotating roll 26 may help control the delivery of the adhesive material 30 to plate 24 and typically may rotate at a lower velocity $U_1$ than the velocity $U_2$ of the applicator roll. In general, the ratio $U_1/U_2$ may be from 0.1 to 0.9, more specifically from about 0.2 to 0.6, and most specifically from about 0.3 to about 0.5.

The applicator roll 28 may be substantially smooth, for example a chrome plated steel roll, a ceramic roll, or a roll with a polymeric cover, or alternatively may be a textured roll, such as an engraved anilox roll of any variety known in the art. The counter-rotating roll 26 generally is smooth, but may also be textured if desired and may comprise any material known in the art.

The adhesive material 30 that follows the applicator roll 28 is transferred to the upper portions of the flexographic plate 24. The thickness of the film of adhesive material applied to the flexographic plate 24 on the plate cylinder 22 may be governed by controlling roll speeds, adhesive and roll temperature, application rate, adhesive viscosity as well as other factors.

In one embodiment, the adhesive material is printed by a flexographic plate at a temperature of about 50° C. or higher, specifically about 70° C. or higher, more specifically about 100° C. or higher, and most specifically about 120° C. or higher. The flexographic plate may be heated by infrared radiation, internal heating in the flexographic cylinder, by the application of sufficiently hot adhesive material, and the like.

The adhesive material 30 applied to the flexographic plate 24 forms a printing layer 32 on the elevated portions of the flexographic plate 24. The printing layer 32 may have a thickness of about 0.03 mm or greater, such as from about 0.05 mm to 2 mm, more specifically from about 0.1 mm to about 1 mm, and most specifically from about 0.2 mm to about 0.7 mm. The printing layer 32 enters a nip 38 between the plate cylinder 22 and an opposing impression cylinder 36 which holds the web 34 against the flexographic plate 24 as it passes through the nip 38, allowing the adhesive material 30 in the printing layer 32 to be applied to the web 34 in a predetermined pattern (not shown).

The mechanically applied pressure in the nip 38 is typically less than that applied in gravure printing and generally does not substantially densify the web 34. For example, the applied load may be expressed in terms of pounds per linear inch and may be less than 200 pli such as from about 0.2 pli to 200 pli, more specifically from about 1 pli to about 60 pli, and most specifically from about 2 pli to about 30 pli, or alternatively, less than about 3 pli. The peak pressure applied to the web 34, as measured with pressure-sensitive nip indicator films, may be less than 100 psi, such as from about 0.2 psi to about 30 psi, more specifically from about 0.5 psi to about 10 psi, and most specifically from about 1 psi to about 6 psi, or alternatively, less than 10 psi or less than 5 psi.

The web 34 travels in the machine direction 42 through the nip 38 and receives printed material 40 in a pattern on a surface 44. Although the printed material 40 is depicted as continuous in FIG. 1, any number of continuous and discontinuous patterns is contemplated. The pattern may define a continuous network of adhesive material 30 or isolated islands of adhesive material 30, a combination thereof, or the like. For example, the pattern may be designed to correspond to the low elevation areas of the web formed by the molding process. For instance, the web may be molded prior to the printing process and the printing pattern may match up with the molded pattern such that the adhesive material may be printed onto the low lying areas of the three dimensional web. Alternatively, the adhesive material may be printed onto the web and subsequently the web may be molded, prior to the adhesive material finally becoming set or cured, such that the printed pattern of the adhesive material is at the low lying areas of the molded web.

The thickness of the printed material 40 relative to the surface 44 of the web 34 may be vary over a wide range of obtainable values. Without limitation, the thickness may be about 1 millimeter or less, specifically about 0.5 mm or less, more specifically about 0.25 mm or less microns, more specifically still about 0.1 mm or less, and most specifically about 0.05 mm or less, with exemplary ranges of from 0 to 0.1 mm, from 0.05 mm to 1 mm, or from 0.1 mm to 0.4 mm.

In an alternative embodiment (not shown), the impression cylinder 36 is removed and the web 34 is simply wrapped around a portion of the flexographic plate 24, such that the force applied to contact the web 34 to the flexographic plate 24 is provided by the tension in the web 34, and such that the contact time between the web 34 and the flexographic plate 24 is correspondingly larger due to a contact length that may be much greater than the nip length in the nip 38. Such an embodiment is known as "kiss coating." The low application pressure may help keep the coating material 30 on the surface 44 of the web 34 in this non-compressive process. This keeps the material on the upper surface of the web. Kiss coating may also be done with a gravure cylinder (not shown), an applicator roll 28, or other cylinder-containing adhesive for non-compressive printing to the web 34. In one embodiment, kiss coating is done with an applicator roll 28 (e.g., an anilox roll) with a surface pore volume of 2 billion to 6 billion cubic microns per square inch (BCM). For kiss coating or any other embodiment, digital drives and control systems may be used to maintain proper speed of all components.

Figure 2:
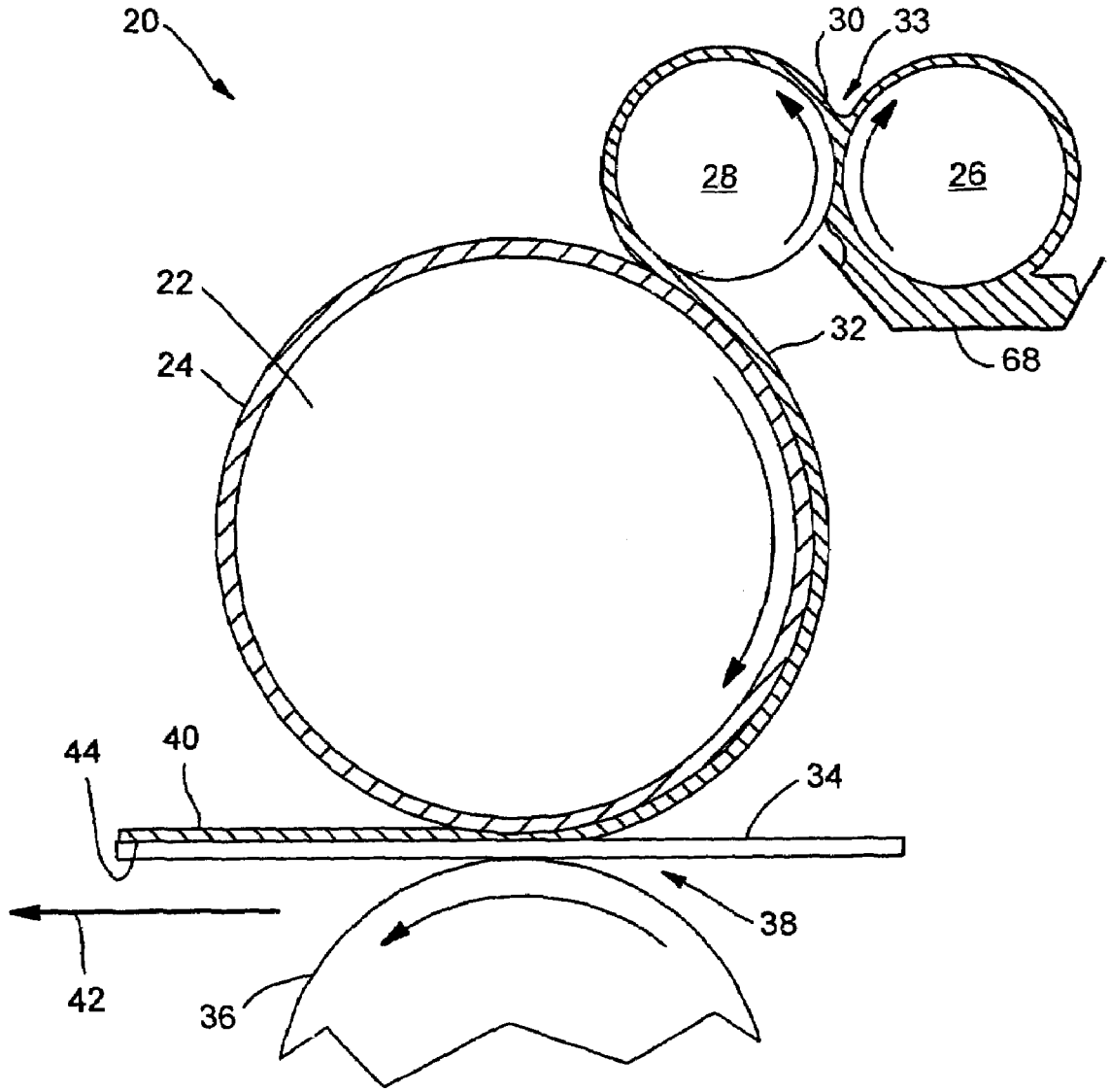
FIG. 2 depicts another embodiment of a flexographic printing apparatus suitable for use in the process of the present invention.

FIG. 2 is a schematic of another embodiment of a flexographic printing apparatus 20 suitable for use in the process of the present invention. The flexographic printing apparatus 20 employs a metered nip 33 between two counter-rotating rolls 26, 28. Adhesive material 30 may be applied to the counter-rotating roll 26 via any means such as a nozzle (not shown) through which the adhesive material 30 is applied. Excess adhesive material 30 may be collected in a tray 68. Adhesive material 30 may also be applied by contact of the counter-rotating roll 26 with adhesive material 30 in the tray 68.

Figure 3:
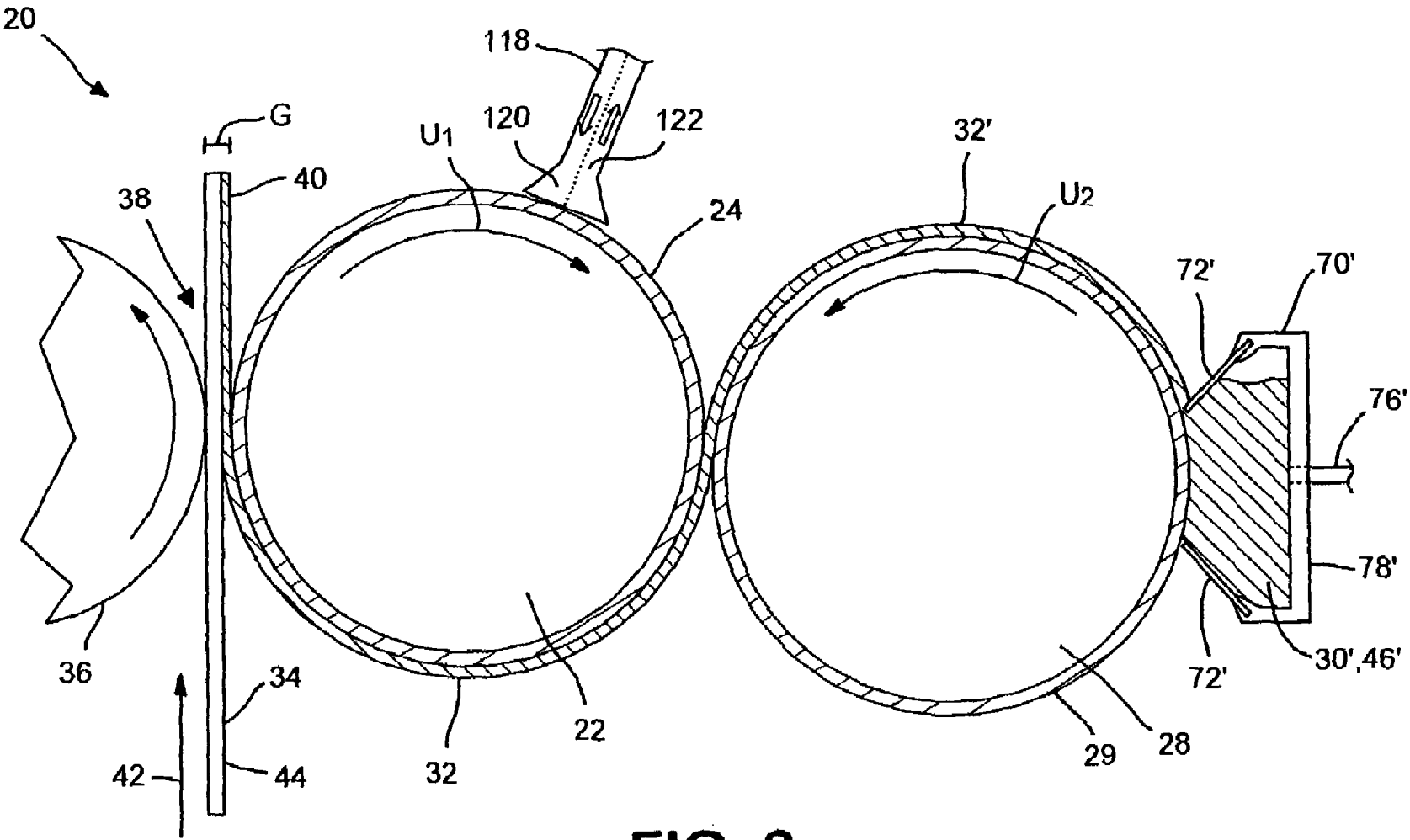
FIG. 3 shows another embodiment of a flexographic printing apparatus suitable for use in the process of the present invention.

FIG. 3 depicts another embodiment of a flexographic printing apparatus 20 for use in the processes of the present invention. The adhesive material 30' is applied to the flexographic plate 24 by means of an applicator roll 28 which receives a metered coating of adhesive material 32' (or adhesive material 30' applied to depressions in the surface of the applicator roll 28) by means of an enclosed application chamber 70' having a chamber body 78' connected to an inlet tube 76' for receiving adhesive material 30' in flowable form (e.g., a liquid or a slurry), and further provided with a leading blade 72' and a trailing blade 72' for keeping the adhesive material 30' in a pool 46' in contact with the cover 29 of the applicator roll 28. The trailing blade 72' is adjusted to meter a desired amount of the adhesive material onto the applicator roll 28. Optionally, the application chamber 70' may be heated and maintained at a substantially constant temperature with temperature control means (not shown) to provide the adhesive material 30' at a desired viscosity.

The applicator roll 28 is depicted as having a polymeric cover 29 which may be deformable, such as a high-temperature elastomeric material, or may be a polymer with low affinity for the molten adhesive material 30 to promote good transfer from the applicator roll 28 to the flexographic plate 24.

The flexographic cylinder 22 rotates at a first velocity $U_1$ (velocity being measured at the outer surface of the roll), while the applicator roll 28 rotates at a second velocity $U_2$. The second velocity $U_2$ can be substantially less than the first velocity $U_1$ for metering of the coating of adhesive material 32', 32 to the flexographic plate 24. For example, the ratio $U_2/U_1$ may be from about 0.2 to 1, more specifically from about 0.4 to 0.8, and most specifically from about 0.4 to about 0.7.

The flexographic cylinder 22 may be cleaned to remove excess adhesive material 30' still on the flexographic plate 24 after printing of the web 34 in the nip 38. A plate cleaner 118 may be used which comprises an inlet line 120 conveying a cleaning material (not shown) to the surface of the flexographic plate 24, in cooperation with an adjacent vacuum line 122 for removing the cleaning material and excess adhesive material 30' conveyed thereby. The cleaning material may be a solvent, including water (e.g., a spray of water droplets or water jets) or steam, for water-soluble adhesive materials (e.g., water soluble hot melts) or water-based emulsions (e.g., a latex). The cleaning material may also be an organic solvent or other materials. Commercial plate cleaners may be used, such as Tresu Plate Cleaners (Tresu, Inc., Denmark) or the plate cleaners of Novaflex, Inc. (Wheaton, Ill.).

Figure 13:
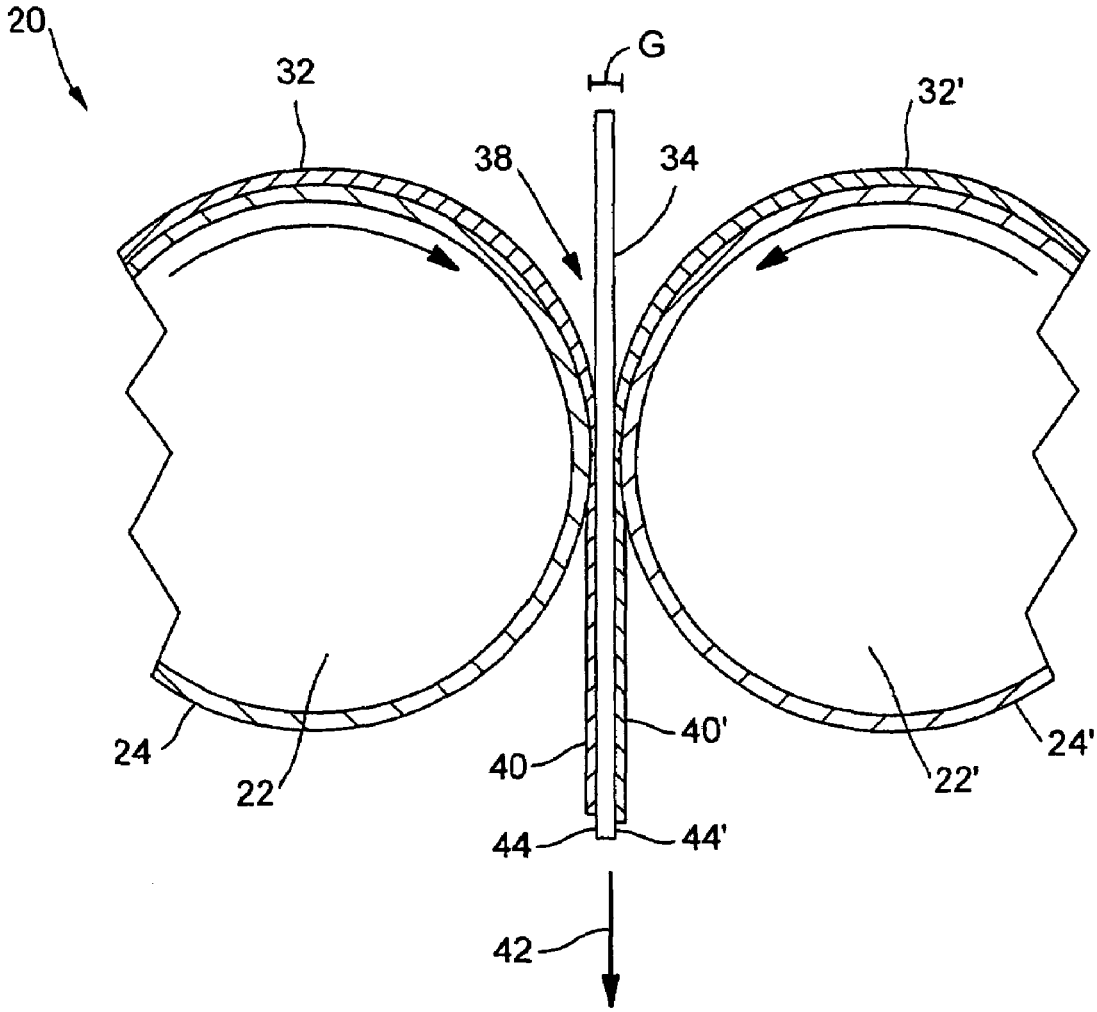
FIG. 13 depicts an embodiment of a flexographic printing system.

FIG. 13 depicts another embodiment of a flexographic printing apparatus 20 for use in the processes of the present invention. The apparatus 20 operates in duplex flexographic mode with similar equipment on both sides of the web 34, including opposing first and second plate cylinders 22, 22', with first and second flexographic plates 24, 24' upon which first and second adhesive materials 32, 32' have been provided, respectively by any means, such as by transfer of the adhesive materials 30, 30' from applicator rolls (not shown) as in a duplex four-roll flexo system. The respective applicator rolls (not shown) that cooperate with the first and second flexographic plates 24, 24' may receive the adhesive material 32, 32' by any means known in the art, such as by a spray, a curtain of melt or liquid flowing onto the applicator rolls, transfer from a flooded nip or metered nip with a counter-rotating roll (not shown), contact with adhesive materials 32, 32' in a tray or enclosed chamber, delivery of the adhesive material through the interior chamber of a sintered roll to the surface thereof, from which the adhesive material is transferred to the flexographic plates 24, 24', and so forth. The first and second flexographic plates 24, 24' are separated by a gap offset G which may be adjusted to prevent substantial densification or crushing of a high-bulk web 34. When the flexographic plates 24, 24' receive adhesive material 32, 32' from applicator rolls in fluid communication with an enclosed chamber (not shown), the printing equipment configuration on both sides of the web 34 may resemble that shown for printing on one side of the web 34 in FIG. 3.

Unlike the method of driving ink transfer in conventional flexography, the process of the present invention may print an adhesive material onto a web surface with very little or even no additional pressure at a printing nip of a printing apparatus. For instance, in some embodiments, the adhesive material-bearing surfaces of the plate cylinder need not press against the web as it resides on a smooth impression cylinder. Local web tension as the web is held by raised elements on the plate cylinder may suffice to cause suitable web contact against the adhesive material to permit transfer of the adhesive material onto the surface of the web. As such, in some embodiments, the printing process may be carried out with a flexographic printing apparatus which does not include an impression cylinder at all.

In one embodiment of the present invention, the web may be molded into the desired three-dimensional state through subjecting the web to microstraining forces. Subjecting the web to microstraining forces may mold the web as desired, and may also further improve the tactile properties of the web. In general, microstraining of a web includes any process in which a web may be significantly softened without any or without significant loss of strength by passing the sheet through one or more nips in which relatively weak papermaking bonds within the sheet are broken while the stronger bonds are left intact. Breaking the weaker bonds within the sheet is manifested in a more open sheet structure which may be quantified by the increased measure of the percent void area exhibited in cross sections of the treated sheet. Unlike embossing processes, microstraining avoids z-direction compaction of the sheet. See, for example, U.S. Pat. No. 5,743,999 to Kamps, et al. which is herein incorporated by reference thereto as to all relevant material.

In one embodiment, a variation of flexographic printing may be applied in which the web is printed with adhesive material at the same time as it is molded by being placed under microstraining forces within the printing nip. For example, the impression cylinder may be textured to approximate a reverse image of the plate cylinder, such that the web is strained at a microscopic level as the raised adhesive material-bearing portions of the plate cylinder push the web into small depressions of the impression cylinder. In one sense, the flexographic plate on the plate cylinder and the impression cylinder could be considered interdigitating rolls. In such an embodiment, wherein the flexographic plate and the impression cylinder are both textured so as to microstrain the web, the hardness of both rolls as well as the texture of the rolls may be optimized for optimum printing and microstraining. For example, the Shore A hardness of either roll may exceed 40, 60, or 80 in such an embodiment. In addition, a combined printing and microstraining step may be followed or preceded by additional microstraining steps to achieve the desired tactile properties.

Figure 4:
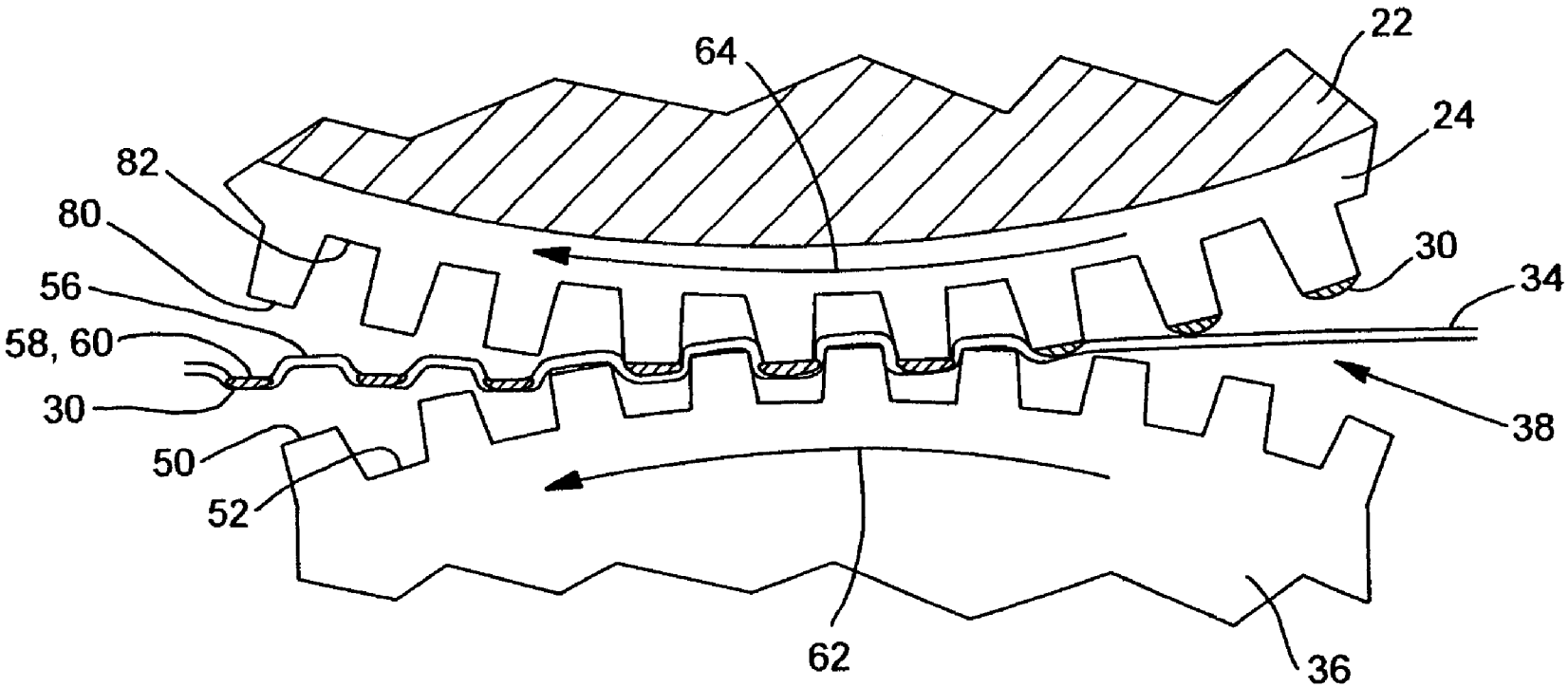
FIG. 4 depicts one embodiment of an interdigitating nip in a flexographic printing system.

FIG. 4 illustrates a nip 38 in which printing of an adhesive material 30 and molding of a web 34 may occur simultaneously. The nip 38 is formed between the plate cylinder 22, covered with a flexographic plate 24, and an opposing impression cylinder 36 which has a textured surface with protrusions 50 and recessed portions 52 that interdigitate with the textured flexographic plate 24 which also has protrusions 80 and recessed portions 82. The protrusions 80 of the flexographic plate 24 may then be coated with the desired adhesive material 30 which may be transferred in the nip 38 to the web 34 to form a network (not shown) of adhesive material 30 in the depressed portions 58 of the web 34, while providing isolated elevated portions 56 of the web 34 that are substantially free of the adhesive material 30. The pressure applied to the web in such an embodiment may be pressures which, while suitable to microstrain and mold the web according to the present invention, are low enough so as to not significantly deform the papermaking fibers in the web, such as peak pressure less than about 50 psi or less than about 5 psi.

Additionally, in those embodiments wherein the elevated portions 56 have a width on the order of the length of the fibers in the web 34, the adhesive material 30 in the surrounding depressed portions 58 of the web 34 may provide additional stability to the elevated portions 56, by anchoring the ends of the fibers in the elevated portions 56 of the web 34 in place.

Figure 7A:
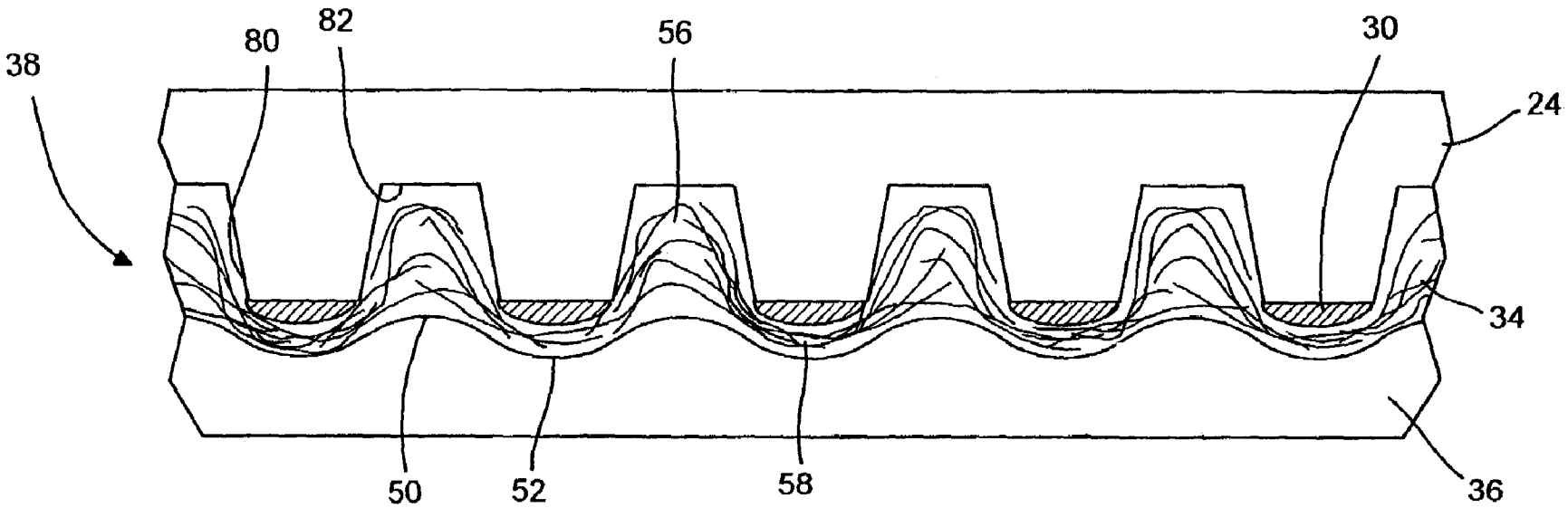
FIGS. 7A and 7B are schematics of embodiments of a nip formed between a flexographic plate and an impression cylinder.

In an alternative embodiment, the web may be molded to the desired three dimensional state and printed with the adhesive binder at the same time, but without an interdigitating impression cylinder as is used in the process illustrated in FIG. 4. For example, FIG. 7A illustrates a schematic showing a close-up of a nip 38 between a flexographic plate 24 and an elastomeric impression cylinder 36 which may be, for example, an elastomeric cover on a metal roll (not shown). The web 34 may be molded by the alternating pattern of protrusions 80 and recessed portions 82 of the flexographic plate 24 as it presses the web 34 against the elastomeric cylinder 36, inducing a series of temporary protrusions 50 and recessed portions 52 in the elastomeric cylinder 36, resulting in the web 34 being molded to have depressed portions 58 and elevated portions 56. The depressed portions 58 of the web 34 are, in this case, relatively more compressed than the elevated portions 56 of the web 34. Adhesive material 30 on the protrusions 80 of the flexographic plate 24 may come into contact with the web 34 in the nip 38, and may be transferred to the web 34. The added adhesive material 30 may form a continuous network (not shown) of adhesive material 30 in the depressed portions 58 of the web 34 which may surround and stabilize the elevated portions 56 of the web 34, thus locking in the three-dimensional structure of the web 34 that was imparted during molding in the nip 38.

In an alternative embodiment related to FIG. 7A, the impression cylinder 36 may be substantially rigid (e.g., metallic or hard rubber), such that it remains substantially flat in the nip.

Figure 7B:
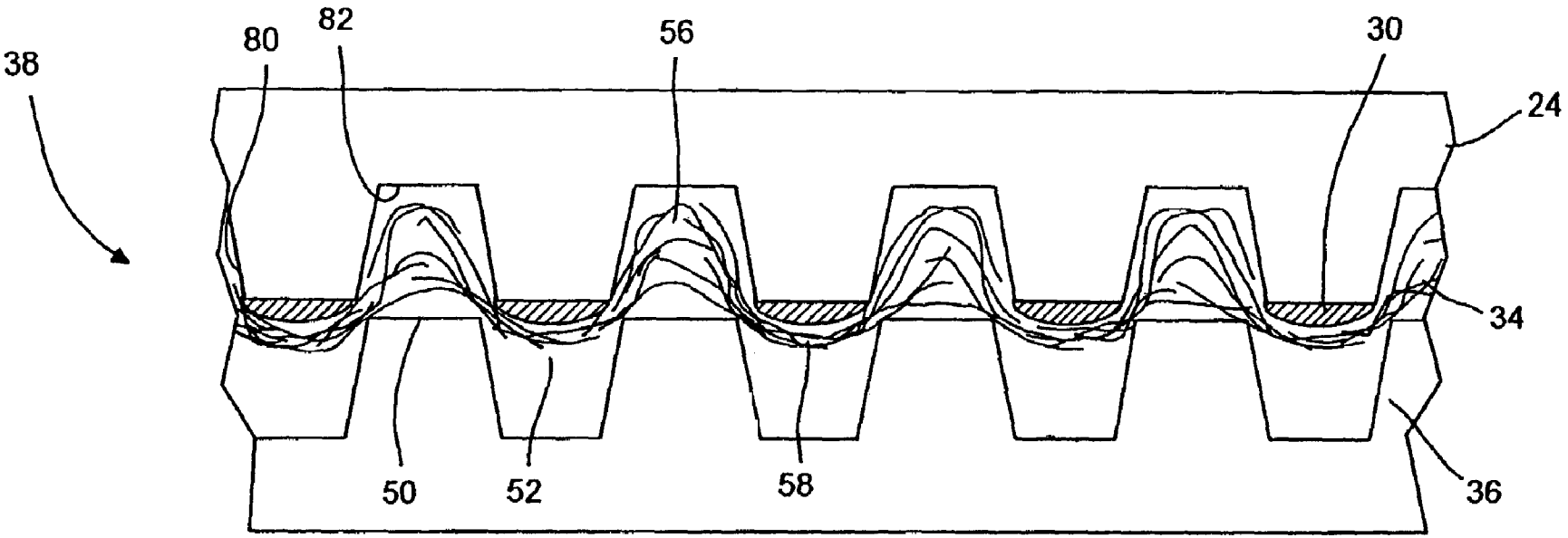

FIG. 7B shows an alternate embodiment of a nip 38 between a flexographic plate 24 and an impression cylinder 36 having a pattern corresponding to that of the flexographic plate 24, but skewed (offset) relative to the flexographic plate 24 such that the permanent protrusions 50 of the impression cylinder 36 are registered with the recessed portions 82 of the flexographic plate 24. The impression cylinder 36 may be rigid or deformable. In an alternative registered embodiment (not shown), the permanent protrusions 50 of the impression cylinder 36 may be registered with the protrusions 80 and of the flexographic plate 24 in the nip.

Additionally, if desired, the web may also be microstrained by brushing, calendering, ring-rolling, or Walton roll treatment to achieve the desired tactile properties. Such treatments may be applied before or after printing with adhesive. Rush transfer may also be used as a means of microstraining the web, wherein in-plane compressive stresses may cause buckling and internal delamination of the web. In one embodiment internal delamination may occur during rush transfer when one side of the web is moist and the other dry, such as immediately after printing one side of the web with a water-based ink or the adhesive material of the present invention.

In another possible embodiment of the present invention, the web may be microstrained through used of an S-wrap technique, such as that method disclosed in U.S. Pat. No. 6,214,274 to Melius, et al. (herein incorporated by reference as to all relevant matter). In this embodiment, the web may be passed over rollers with relatively small diameters to force the web to follow an S-shaped path, which may encourage differentials in tangential forces acting on either side of the web, effectively microstraining the web.

Another possible embodiment of the present invention may include microstraining the web through use of Walton roll treatment. A Walton roll refers to a pair of circumferentially grooved, mated rolls that deform a web passing through the nip formed by the rolls, and disclosed in U.S. Pat. No. 4,921,643 to Walton (herein incorporated by reference as to all relevant matter).

Another possible method of microstraining a web may be found in U.S. Pat. No. 5,562,645 to Tanzer, et al. (herein incorporated by reference as to all relevant matter). In which pulp rolls were microstrained by working the pulp sheet through a nip between pairs of counter-rotating engraved metal rolls which had been gapped to mechanically soften the sheet without cutting or tearing. Multiple passes may be used to produce a desired amount of sheet softening.

In one embodiment, the adhesive material may be printed onto both surfaces of the base web. For example, two printing steps may be used to provide printing of adhesive material to both surfaces of the web. Alternatively, an interdigitated system such as that shown in FIG. 4 may be used, and the impression cylinder may also serve as a plate cylinder such that adhesive materials may be printed on both sides of the web in a single printing step. Printing both sides of the web in patterns that are staggered with respect to each other may provide both strength and good flexibility in the web. Alternatively, two sided printing may be done such that the two patterns on the opposing surfaces of the web align with each other, so that printed regions on one side are directly opposite printed regions on the opposing side. Alternatively, the printed patterns on the two sides of the web may be substantially different, such that there are random regions with and without adhesive overlap on the two sides.

Figure 8:
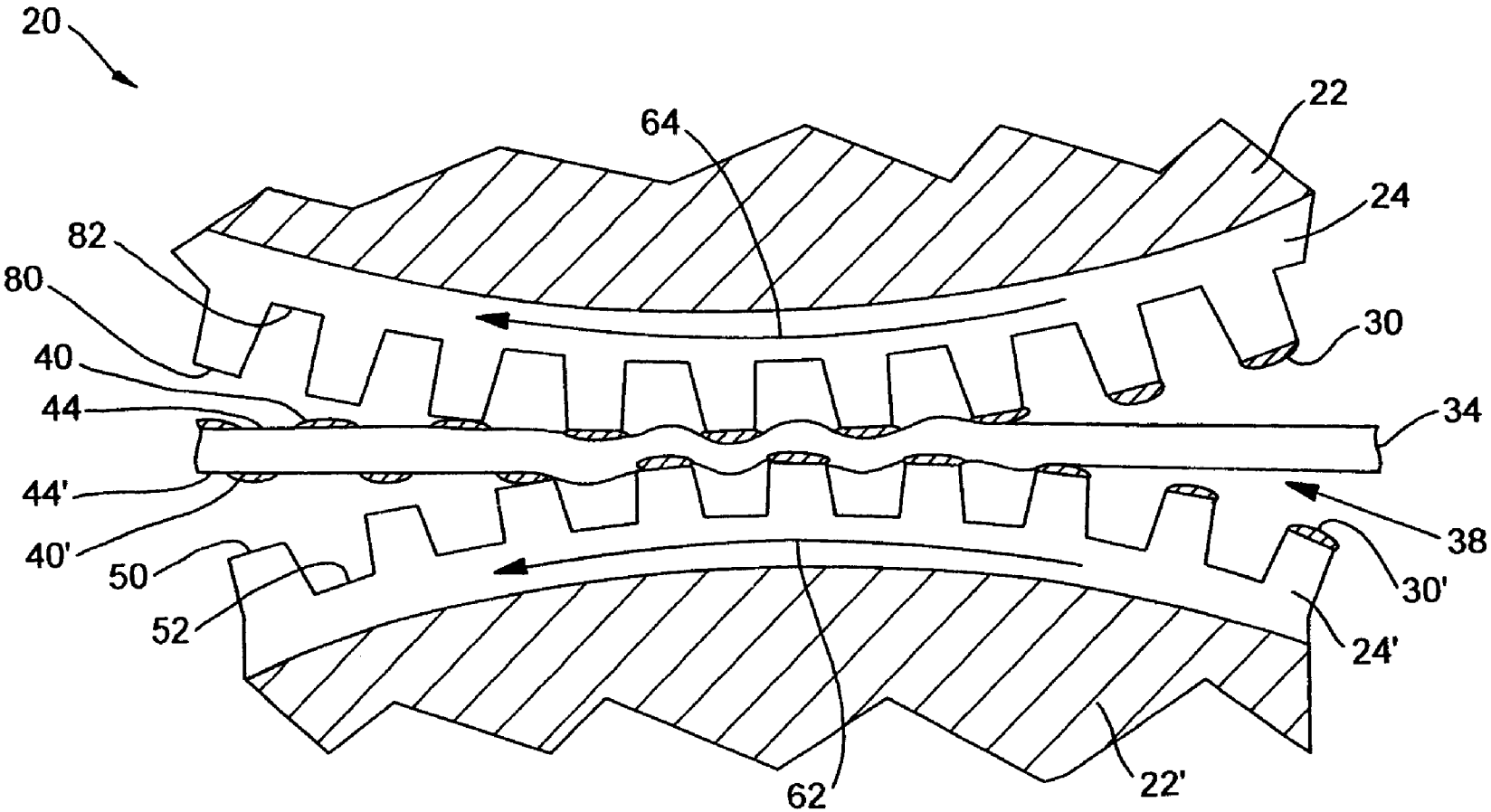
FIG. 8 is a schematic of an embodiment of a duplex flexographic nip as a web is printed with adhesive on both sides.

FIG. 8 depicts an embodiment of a duplex flexographic printing apparatus 20 in which first and second adhesive materials 30, 30' are applied simultaneously to both sides of a web 34 as the web 34 contacts firsts and second flexographic plates 24, 24', respectively, in a nip 38 between first and second cylinders 22, 22', respectively. As shown, the patterns on first and second flexographic plates 24, 24' are not aligned but are skewed such that the printed adhesive deposits 40, 40' on the first and second surfaces 44, 44', respectively, of the web 34 are generally not directly above or beneath each other, but are staggered relative to each other. In other embodiments, the patterns on the opposing flexographic plates 24, 24' could be aligned or could randomly vary relative to each other. When the first and second flexographic plates 24, 24' are identical, one may be rotated with respect to the other, if desired, to prevent printing of identical overlapping patterns on both sides of the web 34, or they may be aligned such that identical overlapping patterns are printed.

Delivery of the adhesive material to the surface of a web is not limited to flexographic printing technologies. Delivery of the adhesive in a desired pattern may be achieved with any relatively non-compressive printing technique as long as the temperature and other parameters of the process are controlled to provide an adhesive material with suitable viscosity for the printing process. For example, various inkjet printing methods may be used, including thermal drop on demand (DoD) inkjet, piezoelectric DoD inkjet, airbrush/valve jet, continuous inkjet, electrostatic sublimation and resin, electrophotography, laser and LED, thermal transfer, photographic development, and the like. An exemplary commercial digital printing system suitable for use in the present invention is the CreoScitex SP laser imaging system.

By way of example only, the adhesive material may be one of the Advantra™ series of hotmelts from H.B. Fuller Company (St. Paul, Minn.), such as HL 9253 packaging adhesive which as a recommended application temperature of 350° F., a viscosity of 1640 centiPoise (cP) at 350° F., 2380 cP at 325° F., and 1230 cP at 375° F., a specific gravity of 0.926, a Gardner Color value of 1 (the Gardner Color scale is described in ASTM D-1544, "Standard Test Method for Color of Transparent Liquids (Gardner Color Scale)"). Further examples include the class of Rapidex® Reactive Hot Melt Adhesives as well as the Clarity™ adhesives, both also of H. B. Fuller Company. Clarity™ HL-4164 hot melt adhesive, for example, has a Gardner Color of 4, a recommended application temperature of 300° F., a viscosity at 300° F. of 805 cP, a viscosity at 250° F. of 2650 cP, and a viscosity at 350° F. of 325 cP, with a specific gravity of 0.966. The Epolene waxes of Eastman Chemical Company represent another class of suitable hotmelts. One example is Epolene™ N021 Wax, with a softening point (Ring and Ball Softening Point) of 120° C., a weight-averaged molecular weight of 6,500 and a number-averaged molecular weight of 2,800 (unless otherwise specified, "molecular weight" as used herein refers to number-weighted molecular weight), a Brookfield viscosity of 350 cP at 150° C., and a cloud point of 87° C. (for a 2% solution in paraffin at 130° C.). Another example is Epolene™ G-3003 Polymer, with a softening point of 158° C., a Brookfield viscosity at 190° C. of 60,000 cP, and a weight-averaged molecular weight of 52,000 and a number-averaged molecular weight of 27,200 and an acid number of 8 (in one embodiment, suitable hotmelts may have an acid number of about 8 or less, such as less than 2).

In one embodiment, latex may be a useful adhesive material. Latex emulsions or dispersions generally comprise small polymer particles, such as crosslinkable ethylene vinyl acetate copolymers, typically in spherical form, dispersed in water and stabilized with surface active ingredients such as low molecular weight emulsifiers or high molecular weight protective colloids. When latex is used, the latex may be anionic, cationic, or nonionic. Crosslinking agents such as NMA may be present in a latex polymer, added as a separate ingredient, or not present at all. A latex emulsion may be thickened, if desired, with known viscosity modifiers such as Acrysol® RM-8 from Rohm & Haas Company (Philadelphia, Pa.).

A variety of commercial latex emulsions may be considered, including those selected from the Rovene® series (styrene butadiene latices available from Mallard Creek Polymers of Charlotte, N.C.); the Rhoplex® latices of Rohm and Haas Company; the Elite®) latices of National Starch, a variety of vinyl acetate copolymer latices, such as 76 RES 7800 from Union Oil Chemicals Divisions and Resyn 25-1103, Resyn 25-1109, Resyn 25-1119, and Resyn 25-1189 from National Starch and Chemical Corporation; ethylene-vinyl acetate copolymer emulsions, such as Airflex ethylene-vinylacetate from Air Products and Chemicals Inc.; acrylic-vinyl acetate copolymer emulsions; Synthemul™ 97-726 from Reichhold Chemicals Inc.; vinyl acrylic terpolymer latices, such as 76 RES 3103 from Union Oil Chemical Division; acrylic emulsion latices, such as Rhoplex™ B-15J or other Rhoplex™ latex compounds from Rohm and Haas Company; and Hycar 2600×322 and related compounds from B. F. Goodrich Chemical Group; styrene-butadiene latices, such as 76 RES 4100 and 76 RES 8100 available from Union Oil Chemicals Division; Tylac™ resin emulsions from Reichhold Chemical Inc.; DL6672A, DL6663A, DL6638A, DL6626A, DL6620A, DL615A, DL617A, DL620A, DL640A, and DL650A available from Dow Chemical Company; rubber latices, such as neoprene available from Serva Biochemicals; polyester latices, such as Eastman AQ 29D available from Eastman Chemical Company; vinyl chloride latices, such as Geon™ 352 from B. F. Goodrich Chemical Group; ethylene-vinyl chloride copolymer emulsions, such as Airflex™ ethylene-vinyl chloride from Air Products and Chemicals; polyvinyl acetate homopolymer emulsions, such as Vinac™ from Air Products and Chemicals; carboxylated vinyl acetate emulsion resins, such as Synthemul™ synthetic resin emulsions 40-502, 40-503, and 97-664 from Reichhold Chemicals Inc. and Polyco™ 2149, 2150, and 2171 from Rohm and Haas Company. Silicone emulsions and binders may also be considered.

In one embodiment, the adhesive material is not a latex, and in another embodiment the printed web may be substantially latex free or substantially free of natural latex.

In those embodiments wherein the adhesive material is insoluble or resistant to water, the resulting molded web may have high wet resiliency, characterized by an ability to maintain high bulk and a three-dimensional structure when wet. In those embodiments wherein the adhesive material is printed on both sides of a web, the adhesive may be the same or different compositions on either side.

When a hotmelt adhesive is used, the equipment for processing the hotmelt and supplying a stream of hotmelt to the printing systems of the present invention may be any known hotmelt or adhesive processing devices. For example, the ProFlex® applicators of Hot Melt Technologies, Inc (Rochester, Mich.); the "S" Series Adhesive Supply Units of ITW Dynatec, Hendersonville, Tenn., as well as the DynaMelt "M" Series Adhesive Supply Units, the Melt-on-Demand Hopper, and the Hotmelt Adhesive Feeder, all of ITW Dynatec are all exemplary systems which may be used.

The adhesive compound may be substantially free of ink or may be a compound that does not comprise an ink.

Silicone pressure sensitive adhesive materials could also be used in the present invention. Exemplary silicone pressure sensitive adhesives which may be used may include those commercially available from Dow Corning Corp., Medical Products and those available from General Electric. While not limiting, examples of possible silicone adhesives available from Dow Corning include those sold under the trade names BIO-PSA X7-3027, BIO-PSA X7-4919, BIO-PSA X7-2685, BIO-PSA X7-3122 and BIO-PSA X7-4502.

If desired, coloring additives may be included in the adhesive material and the adhesive may be white, colored or colorless. Other optional additives, in addition to inks, may also be added to the adhesive material in minor amounts (typically less than about 25% by weight of the elastomeric phase) if desired. Such additives may include, for example, pH controllers, medicaments, bactericides, growth factors, wound healing components such as collagen, antioxidants, deodorants, perfumes, antimicrobials and fungicides.

The adhesive material may be substantially free of water (e.g., water is not used as a solvent or carrier material for the binder material), or may be substantially free of dyes or pigments (in contrast to typical inks), and may be substantially non-pigmented or uncolored (e.g., colorless or white), or may have a Gardner Color of about 8 or less, more specifically about 4 or less, and most specifically about 1 or less. In another embodiment, HunterLab Color Scale (from Hunter Associates Laboratory of Reston, Va.) measurements of the color of a 50 micron film of the adhesive material on a white substrate yields absolute values for "a" and "b" each about 25 or less, more specifically each about 10 or less, more specifically still each about 5 or less, and most specifically each about 3 or less. The HunterLab Color Scale has three parameters, L, a, and b. "L" is a brightness value, "a" is a measure of the redness (+a) and greenness (−a), and the "b" value is a measure of yellowness (+b) and blueness (−b). For both the "a" and "b" values, the greater the departure from 0, the more intense the color. "L" ranges from 0 (black) to 100 (highest intensity). The adhesive material may have an "L" value (when printed as a 50 micron film on a white background) of about 40 or greater, more specifically about 60 or greater, more specifically still about 80 or greater, and most specifically about 85 or greater. Measurement of materials to obtain HunterLab L-a-b values may be done with a Technibryte Micro TB-1C tester manufactured by Technidyne Corporation, New Albany, Ind., USA.

In one embodiment, the adhesive material may comprise an acrylic resin terpolymer. For example, the adhesive material may comprise an acrylic resin terpolymer containing 30 to 55 percent by weight styrene, 20 to 35 percent by weight acrylic acid or methacrylic acid and 15 to 40 percent by weight of N-methylol acrylamide or N-methylol methacrylamide, or may comprise a water-soluble melamine-formaldehyde aminoplast and an elastomer latex.

Other suitable adhesives include acrylic based pressure sensitive adhesives (PSAs), suitable rubber based pressure sensitive adhesives and suitable silicone pressure sensitive adhesives. Examples of suitable polymeric rubber bases include one or more of styrene-isoprene-styrene polymers, styrene-olefin-styrene polymers including styrene-ethylene/propylene-styrene polymers, polyisobutylene, styrenebutadiene-styrene polymers, polyisoprene, polybutadiene, natural rubber, silicone rubber, acrylonitrile rubber, nitrile rubber, polyurethane rubber, polyisobutylene rubber, butyl rubber, halobutyl rubber including bromobutyl rubber, butadieneacrylonitrile rubber, polychloroprene, and styrene-butadiene rubber.

In one embodiment, a rubber based adhesive may be used that may have a thermoplastic elastomeric component and a resin component. The thermoplastic elastomeric component may contains about 55–85 parts of a simple A-B block copolymer wherein the A-blocks are derived from styrene homologs and the B-blocks are derived from isoprene, and about 15–45 parts of a linear or radical A-B-A block copolymer wherein the A-blocks are derived from styrene or styrene homologs and the B blocks are derived from conjugated dienes or lower alkenes, the A-blocks in the A-B block copolymer constituting about 10–18 percent by weight of the A-B copolymer and the total A-B and A-B-A copolymers containing about 20 percent or less styrene. The resin component may comprise tackifier resins for the elastomeric component. In general, any compatible conventional tackifier resin or mixture of such resins may be used. These include hydrocarbon resins, rosin and rosin derivatives, polyterpenes and other tackifiers. The adhesive composition may contain about 20–300 parts of the resin component per one hundred parts by weight of the thermoplastic elastomeric component. One such rubber-based adhesive is commercially available from Ato Findley under the trade name HM321 0.

Many different types of monomers and cross-linkable resins are known in the polymer art, their properties may be adjusted as taught in the art to provide rigidity, flexibility, or other properties.

Various types of elastomeric compositions are known, such as curable polyurethanes. The term "elastomer" or "elastomeric" is used to refer to rubbers or polymers that have resiliency properties similar to those of rubber. In particular, the term elastomer reflects the property of the material that it may undergo a substantial elongation and then return to its original dimensions upon release of the stress elongating the elastomer. In all cases an elastomer must be able to undergo at least 10% elongation (at a thickness of 0.5 mm) and return to its original dimensions after being held at that elongation for 2 seconds and after being allowed 1-minute relaxation time. More typically an elastomer may undergo 25% elongation without exceeding its elastic limit. In some cases elastomers may undergo elongation to as much as 300% or more of its original dimensions without tearing or exceeding the elastic limit of the composition. Elastomers are typically defined to reflect this elasticity as in ASTM Designation DS83-866 as a macromolecular material that at room temperature returns rapidly to approximately its initial dimensions and shape after substantial deformation by a weak stress and release of the stress. ASTM Designation D412-87 may be an appropriate procedure to evaluate elastomeric properties. Generally, such compositions include relatively high molecular weight compounds which, upon curing, form an integrated network or structure. The curing may be by a variety of means, including: through the use of chemical curing agents, catalysts, and/or irradiation. The final physical properties of the cured material are a function of a variety of factors, most notably: number and weight average polymer molecular weights; the melting or softening point of the reinforcing domains (hard segment) of the elastomer (which, for example, may be determined according to ASTM Designation D1238–86); the percent by weight of the elastomer composition which comprises the hard segment domains; the structure of the toughening or soft segment (low Tg) portion of the elastomer composition; the cross-link density (average molecular weight between crosslinks); and the nature and levels of additives or adjuvants, etc. The term "cured", as used herein, means cross-linked or chemically transformed to a thermoset (non-melting) or relatively insoluble condition.

The softening temperature of a thermoplastic polymer may be approximated as the Vicat Softening Temperature according to ATM D 1525–91.

The adhesive material may also comprise acrylic polymers including those formed from polymerization of at least one alkyl acrylate monomer or methacrylate, an unsaturated carboxylic acid and optionally a vinyl lactam. Examples of suitable alkyl acrylate or methacrylate esters include, but are not limited to, butyl acrylate, ethyl acrylate, 2-ethylhexyl acrylate, isooctyl acrylate, isononyl acrylate, isodecyl acrylate, methyl acrylate, methylbutyl acrylate, 4-methyl-2-pentyl acrylate, see-butyl acrylate, ethyl methacrylate, isodecyl methacrylate, methyl methacrylate, and the like, and mixtures thereof. Examples of suitable ethylenically unsaturated carboxylic acids include, but are not limited to, acrylic acid, methacrylic acid, fumaric acid, itaconic acid, and the like, and mixtures thereof. A preferred ethylenically unsaturated carboxylic acid monomer is acrylic acid. Examples of suitable vinyl lactams include, but are not limited to, N-vinyl caprolactam, 1-vinyl-2-piperidone, 1-vinyl-5-methyl-2-pyrrolidone, vinyl pyrrolidone, and the like, and mixtures thereof.

The adhesive may also include a tackifier. Tackifiers are generally hydrocarbon resins, wood resins, rosins, rosin derivatives, and the like. It is contemplated that any tackifier known by those of skill in the art to be compatible with elastomeric polymer compositions may be used with the present embodiment of the invention. One such tackifier found to be suitable is Wingtak 10, a synthetic polyterpene resin that is liquid at room temperature, and sold by the Goodyear Tire and Rubber Company of Akron, Ohio. Wingtak 95 is a synthetic tackifier resin also available from Goodyear that comprises predominantly a polymer derived from piperylene and isoprene. Other suitable tackifying additives may include Escorez 1310, an aliphatic hydrocarbon resin, and Escorez 2596, aC5-C9 (aromatic modified aliphatic) resin, both manufactured by Exxon of Irving, Tex. Of course, as may be appreciated by those of skill in the art, a variety of different tackifying additives may be used to practice the present invention.

In addition to tackifiers, other additives may be used to impart desired properties. For example, plasticizers may be included. Plasticizers are known to decrease the glass transition temperature of an adhesive composition containing elastomeric polymers. An example of a suitable plasticizer is Shellflex 371, a naphthenic processing oil available from Shell Oil Company of Houston, Tex. Antioxidants also may be included on the adhesive compositions. Exemplary antioxidants include Irgafos 168 and Irganox 565 available from Ciba-Geigy, Hawthorne, N.Y. Cutting agents such as waxes and surfactants also may be included in the adhesives.

In another embodiment, the adhesive material may be substantially free of quaternary ammonium compounds, or may be substantially free independently of any of the following or any combination thereof: petrolatum, silicone oil, beeswax, emulsions, paraffin, fatty acids, fattyalcohols, any hydrophobic material with a melting point less than 50° C., epichlorohydrins, conventional papermaking wet strength additives (either temporary or permanent wet strength additives or both), starches and starch derivatives, gums; cellulose derivatives such as carboxymethylcellulose or carboxymethylcellulose; chitosan or other materials derived from shellfish; materials derived from proteins; superabsorbent material; a polyacrylate or polyacrylic acid; cationic polymers, surfactants, polyamides, polyester compounds, chlorinated polymers, heavy metals, water soluble polymers, water-soluble salts, a slurry, a dispersion, and opaque particles. It may also have a softening temperature about 60° C., such as about 80° C. or greater, more specifically about 100° C. or greater, most specifically about 130° C. or greater.

Curing of the adhesive, i.e., drying or otherwise setting of the adhesive material, may begin before, during, or after the web is deformed to assume a more three-dimensional shape, and completion of curing may occur while the web is in contact with a molding substrate or alternatively after the web has been removed from a molding substrate, but in any case prior to relaxation of the added texture into a more two dimensional state. The adhesive material printed on the web may set or cure in any fashion. For example, the adhesive material may set or cure through application of heat, ultraviolet light or other forms of radiation, or due to chemical reaction which may merely require passage of a period of time. In one embodiment, the adhesive may cure through application of airflow, as when the base web is pressed against a molding substrate by pneumatic pressure.

The adhesive, after application to the web, may be substantially non-tacky (particularly after it has cooled to a temperature of 40° C. or less, or 30° C. or less). In many embodiments, the printed adhesive material is not used to join the tissue web to any other layer or article, but is used to modify at least one of the following: the structure of the tissue web, the strength properties of the tissue web, the topography of the tissue web (increasing the texture or surface depth of the web), the wetting properties of the web, and the tactile properties of the web. More specifically, the printing of adhesive is used to create a high bulk web with enhanced texture and improved strength or wet resiliency. Wet Compressed Bulk refers to the bulk of a fully wetted tissue sample (wetted to a moisture ratio of 1.1 g water/g dry fiber) under a load of 2 psi. Springback, refers to the ratio of final low-pressure thickness at 0.025 psi to the initial low-pressure thickness at 0.025 psi of a fully wetted sample after two intervening compressive cycles comprising loading the tissue to 2 psi followed by removing the load. By way of example, a Springback of 1 indicates no loss in bulk of the sample due to intermediate compressions to 2 psi, whereas a value of 0.5 indicates that half of the bulk was maintained. The Wet Compressed Bulk of the web may be increased by about 5% or more, specifically by about 10% or more, more specifically by about 15% or more, most specifically by about 25% or more, by flexographic printing of adhesive according to the present invention, relative to an unprinted but otherwise substantially identical sample. The Springback may be increased by 0.03 or more, more specifically by about 0.05, most specifically by about 0.1 or more, by flexographic printing of adhesive according to the present invention, relative to an unprinted but otherwise substantially identical sample.

The adhesive material may be applied to the web in any desired pattern. For example, the adhesive material may form a continuous network or an effectively continuous network, such as through a pattern of small, discrete dots. A pattern of small discrete dots may be effectively continuous when the dots are spaced apart at a distance substantially less than the typical fiber length such that the dots define a pattern capable of enhancing the tensile strength of the web. For example, a web may be formed including softwood fibers with a mean fiber length of about 4 mm, and a pattern of fine dots having a diameter of about 0.5 mm or less may be spaced apart less than 1 mm between centers of the dots in a large-scale honeycomb pattern or rectilinear grid pattern, wherein the width of the characteristic adhesive free honeycomb cell or rectilinear grid cell is about 3 mm or less.

The adhesive material may be printed in any desired pattern such as an interconnected network or a series of isolated elements or a combination of a network and isolated elements. The pattern may define recognizable objects such as flowers, stars, animals, humans, cartoon characters, and the like, or aesthetically pleasing patterns of any kind. For example, the pattern may comprise a series of parallel lines, parallel sinuous curves, a rectilinear grid, a hexagonal grid, isolated or overlapping circles or ellipses, isolated or overlapping polygons, isolated dots and dashes, and the like.

The area of the surface of the web that is covered by the adhesive material may range from about 1% to about 100%, such as from about 5% to about 95%, specifically from about 10% to about 80%, more specifically from about 10% to about 50%, and most specifically from about 10% to about 40%. Alternatively, area of the surface of the web that is covered by the adhesive material may be less than 50%, such as less than 30% or less than 15%, such as from 1% to 15%.

In one embodiment, the parameters of the pattern of the adhesive material that is printed on the sheet may be dependent on the fiber length of the fibers in the outer surfaces of the web. Such interdependence may help to maintain good surface integrity. In those embodiments including long synthetic fibers in one or both outer surfaces of the web, the adhesive may be printed at a coarser scale and the web may still exhibit substantial gain in tensile and strength properties. Thus, with synthetic fibers of, for example, 15 mm or greater average length, the adhesive may be printed in a pattern having a characteristic cell size of about 5 mm or less.

Figure 5:
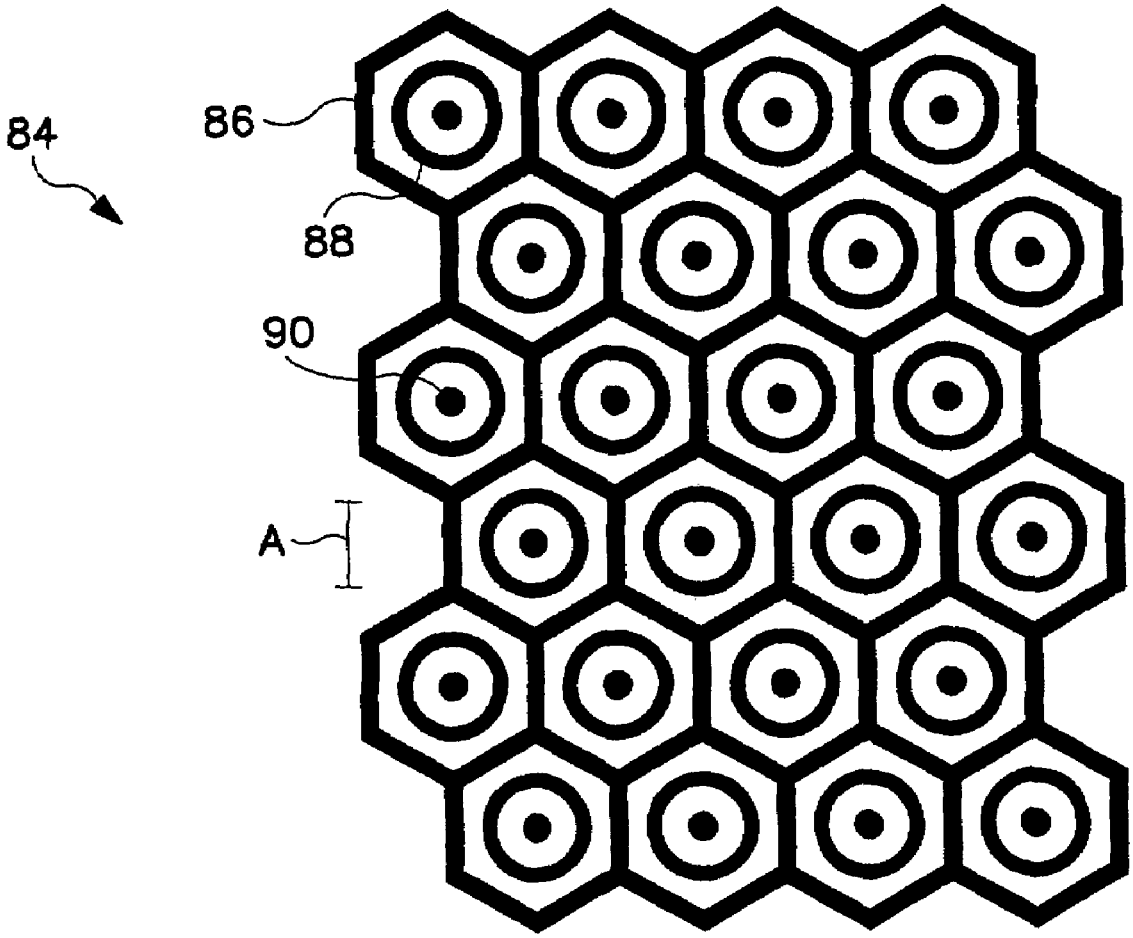
FIG. 5 depicts one possible printing pattern of an adhesive material that may be imparted to a web according to the present invention.

FIG. 5 is a schematic of one embodiment of a pattern 84 of adhesive material that may be printed onto a web (not shown) such as with a corresponding pattern engraved into a flexographic plate. In this embodiment, the pattern 84 includes a continuous network of hexagonal elements 86, with circles 88 and dots 90 within the hexagonal elements 86. The sides of the hexagonal elements 86 may have a characteristic length 'A' that may be about 0.5 mm or greater, more specifically about 1 mm or greater, more specifically still about 2.5 mm or greater, and most specifically about 5 mm or greater, with exemplary ranges of from about 1.5 mm to about 18 mm, or from about 3 mm to about 7 mm. In one embodiment, the characteristic length A is approximately equal to the length-weighed numerical average fiber length of the web or less, such as about 5 mm or less for a typical softwood tissue web or about 2 mm or less for a predominately hardwood tissue web. The pattern 84 of FIG. 5 is, of course, only one of countless different patterns that could be employed. Characteristic unit cells of such patterns may include elements of any shape, such as, for example, rectangles, diamonds, circles, ovals, bow-tie shaped elements, tessellated elements, repeating or non-repeating tile elements, dots, dashes, stripes, grid lines, stars, crescents, undulating lines, and the like, or combinations thereof. The characteristic width or length of the unit cell may be about 0.5 mm or greater, specifically about 1 mm or greater, more specifically about 2 mm or greater, and most specifically about 5 mm or greater, such as from about 0.5 mm to about 7 mm, or from about 0.8 mm to about 3.5 mm.

Figure 6:
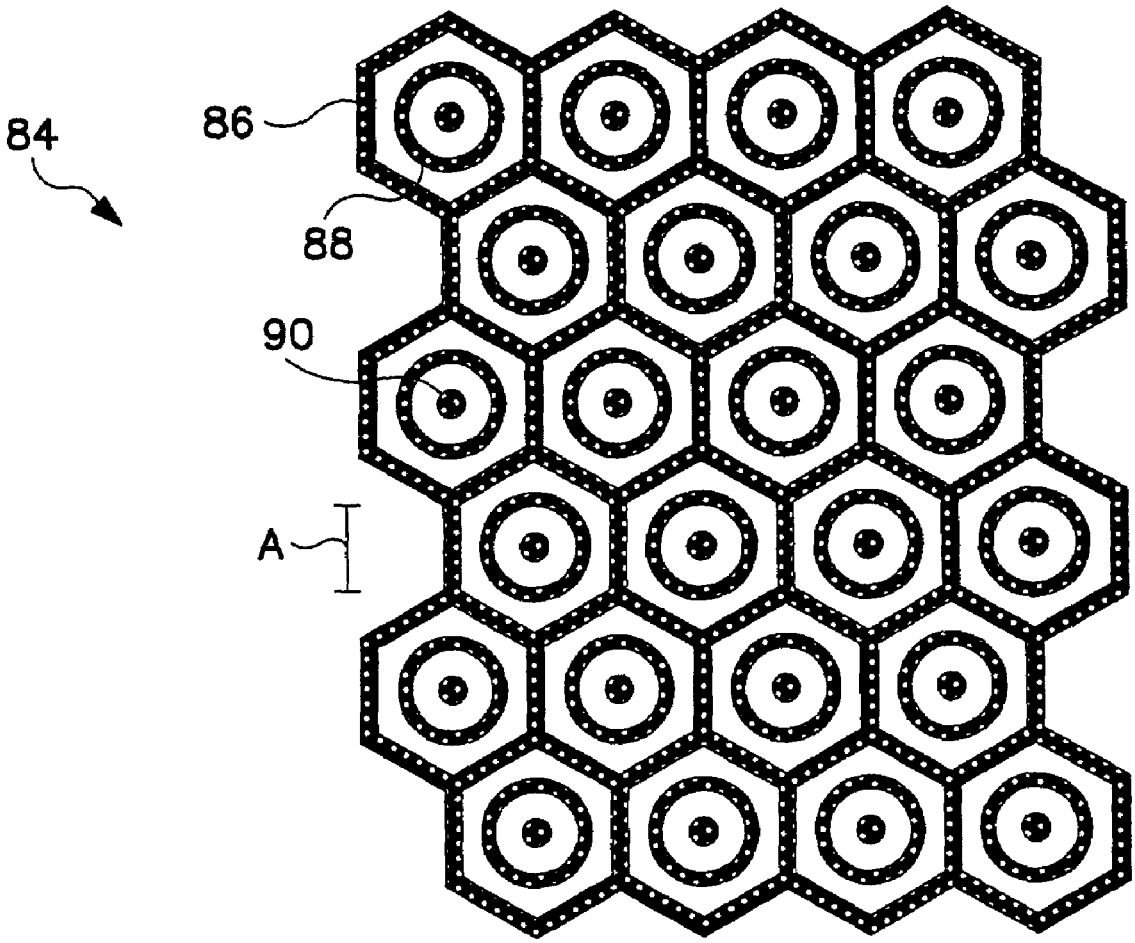
FIG. 6 depicts another possible printing pattern of an adhesive material that may be imparted to a web according to the present invention.

FIG. 6 is a schematic of a pattern 84 of adhesive material similar to that of FIG. 5, except that the present pattern 84 has been screened such that the solid portions of the pattern are broken up with fine dots 94 of unprinted regions. In experiments with hot melt adhesives, it has been found that by providing the screen effect shown in FIG. 6, better transfer of the hot melt to the surface of the web may be achieved. Advantages appear possible even for very small amounts of open surface area in the otherwise solids portions of the pattern. Thus, by combining unprinted dots or other elements to form a screening effect on the pattern 84, improved texturing of the web may be achieved. In some embodiments, the pattern of dots in the printing surface may serve as small reservoirs to hold more adhesive and improve transfer to the web. In one embodiment, a screen pattern of dots is burned into the flexographic plate or other printing surface. In one embodiment, the dots may have a diameter of 100 microns or less, more specifically 50 microns or less.

Figure 12:
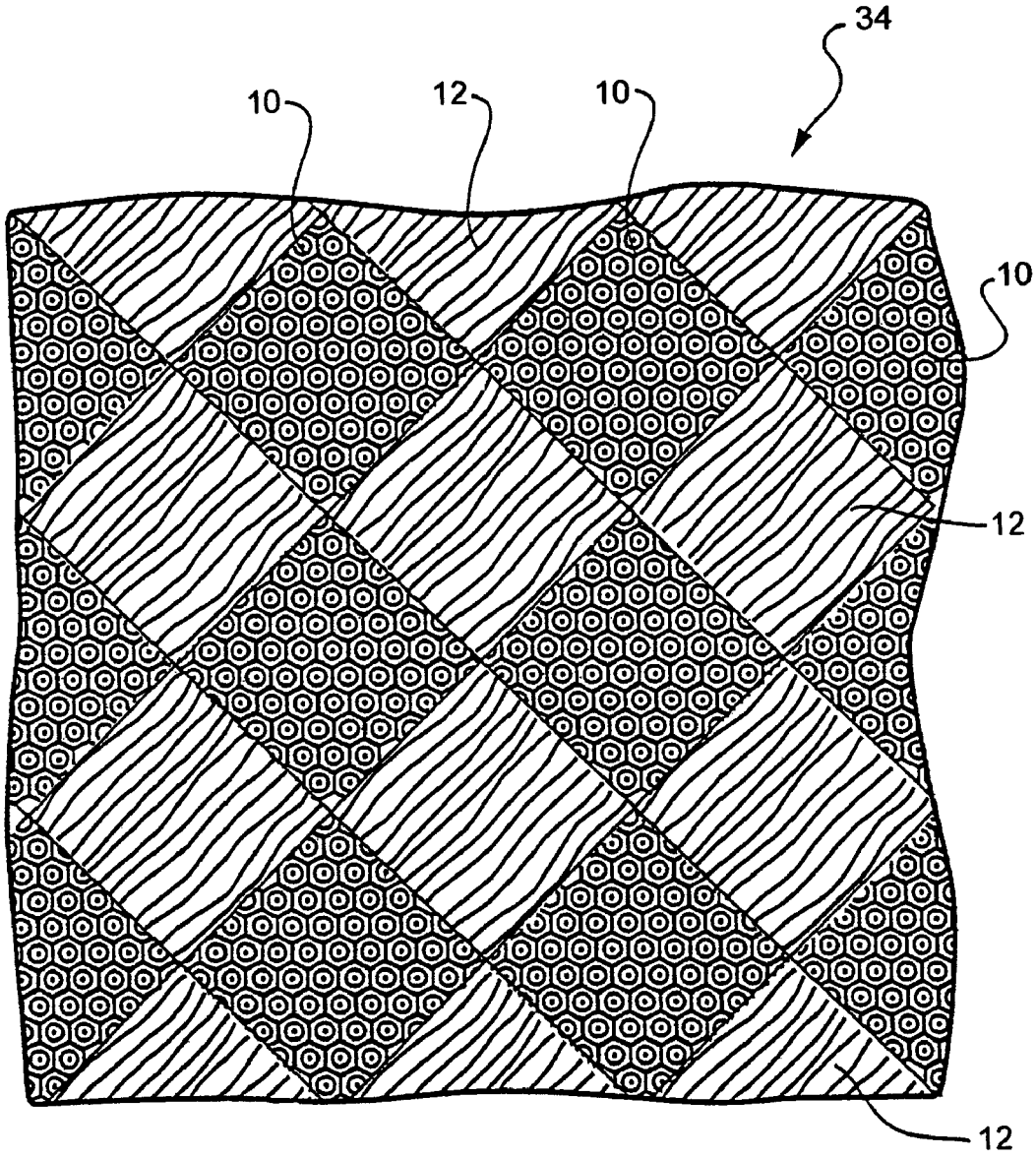
FIG. 12 is one possible embodiment of a heterogeneous pattern of adhesive material which may be printed on a base web according to the present invention.

In one embodiment, the printing pattern of the adhesive material may be a heterogeneous pattern across the surface of the web. In other words, the printing pattern may define different regions of the web, with certain regions including adhesive material which differs in application pattern from the other regions. In one embodiment, regions of the heterogeneously printed web may be all together free of the printed adhesive material. FIG. 12 illustrates one possible embodiment of a heterogeneous printing pattern of the present invention. The printing pattern of FIG. 12 is shown on a portion of a web 34 and includes local regions 10 which are printed with adhesive material in a repeating pattern such as that illustrated by the pattern of FIG. 5. The heterogeneous pattern also includes regions 12 which are printed by the adhesive material in a different repeating pattern than that of the regions 10. Heterogeneous patterns of adhesive material may be designed to provide unique strength and/or tactile characteristics to the web.

The process of the present invention may be carried out online after a web has been dried, or may be offline at a converting facility, as desired. For example, an online paper making process may be modified to include molding, printing, microstraining and molding, and subsequent curing to produce a VIVA®-like towel. In one embodiment of the present invention, a web may be formed, rush transferred, through-dried on a textured fabric, flexographically printed on one or both sides of the web with concurrent microstraining, then through dried to completion, microstrained again, wound and converted.

The paper webs produced by the processes of the present invention may also be printed with other materials, in addition to the adhesive materials of the present invention. For example, any decorative elements known in the art may be additionally printed onto the base webs using the low pressure printing technology such as that of the present invention or alternatively may be applied by other means. Decorative printing may be applied within the scope of the present invention in conjunction with application of the adhesive material, as is the case when the adhesive material is colored and is applied in an aesthetically pleasing pattern. Decorative printing may optionally be applied in a separate step. In one embodiment, decorative pigments such as the liquid crystal pigments may be applied to the webs of the present invention. For example, liquid crystal pigments may be applied to a dark substrate which may create colors that shift depending on the viewing angle ("color flops"). Helicone HC® pigments from Wacker-Chemie are an example of the materials that are used to create these effects. "Color flop" effects may be applied in this manner to any of the articles of the present invention.

Alternatively, any other additives, pigments, inks, emollients, pharmaceuticals or other skin wellness agents or the like described herein or known in the art may be applied to the web of the present invention, either uniformly or heterogeneously. For example, either surface of the web may be printed with an additive according to the present invention, have an additive sprayed substantially uniformly, or have an additive selectively deposited on all or a portion of the web. Skin wellness agents may include, for example, any known skin wellness agents such as, but not limited to, anti-inflammatory compounds, lipids, inorganic anions and cations, protease inhibitors, sequestration agents, antifungal agents, antibacterial agents, acne medications, and the like.

As used herein, the term "paper web" refers to a web comprising at least one layer of a cellulosic fibrous web such as a layer of wet laid paper, air laid fibrous webs, fluff pulp, coform (composites of meltblown polymers and papermaking fibers), and the like. The paper webs of the present invention may be used in many forms, including multilayered structures, composite assemblies, and the like such as two or more tissue plies that have been embossed, crimped, needled, coapertured, or subjected to other mechanical treatments to join them together, or that are joined by hotmelt adhesives, latex, curable adhesives, thermally fused binder particles or fibers, and the like. The plies may be substantially similar or dissimilar. Dissimilar plies may include a creped tissue web joined to an airlaid, a nonwoven web, an apertured film, an uncreped tissue web, a tissue web of differing color, basis weight, chemical composition (differing chemical additives), fiber composition, or may differ due to the presence of embossments, apertures, printing, softness additives, abrasive additives, fillers, odor control agents, antimicrobials, and the like. The web may also be used as a basesheet, such as in construction of wet wipes, paper towels, and other articles. For example, the web may be printed with a latex and then creped. In one embodiment, the web may be used for single or double print-creping. The web may also be printed or otherwise treated with wet strength resins on one side prior to contacting a Yankee dryer, wherein the wet strength resin assists in creping and provides improved temporary wet strength to the web. The tissue web may comprise synthetic fibers or other additives.

However, in one embodiment, the web has less than 20% by weight of synthetic polymeric material prior to printing, more specifically less than 10% by weight of synthetic polymeric material. In another embodiment, the web does not comprise a hydroentangled nonwoven web.

The printed adhesive, in one embodiment, does not penetrate fully into the web but may remain at least 10 microns above the surface of the web, more specifically at least about 20 microns above the surface of the web, most specifically at least about 50 microns above the surface of the web.

In one embodiment, the paper webs of the present invention may be laminated with additional plies of tissue or layers of nonwoven materials such as spunbond or meltblown webs, or other synthetic or natural materials. This could be done before or after printing with adhesive material. For example, in a cellulosic product containing two or more plies of tissue, such as bath tissue, a pair of plies such as the plies forming the opposing outer surfaces of the product may comprise any of the following: a creped and uncreped web; a calendered and uncalendered web; a web comprising hydrophobic matter or sizing agents and a more hydrophobic web; webs of two differing basis weights; webs of two differing embossment patterns; an embossed and unembossed web; a web with high wet strength and a web with low wet strength; a web having syncline marks and a web free of syncline marks; a web with antimicrobial additives and a web free of such additives; a web with asymmetrical domes and one free of domes; a through-dried web and a web dried without use of a through-dryer; webs of two different colors; an apertured web and an unapertured web; and the like. Lamination may be achieved through crimping, perf-embossing, adhesive attachment, etc.

The tissue webs of the present invention may be provided as single ply webs, either alone or in combination with other absorbent material. In another embodiment, two or more webs of the present invention may be plied together to make a multi-ply structure. If adhesive material is printed on only one side of the web, the multi-ply article may have the adhesive-printed sides facing the outside of the multi-ply article or turned toward the inside of the article, such that the unprinted sides face out, or may have one printed side of a web facing out on one surface of the article and an unprinted side facing out on the opposing surface of the article.

The products made from the webs of the present invention may be in roll form with or without a separate core, or may be in a substantially planar form such as a stack of facial tissues, or in any other form known in the art. Products intended for retail distribution or for sales to consumers will generally be provided in a package, typically comprising plastic (e.g., flexible film or a rigid plastic carton) or paperboard, having printed indicia displaying product data and other consumer information useful for retail sales. The product may also be sold in a package coupled with other useful items such as lotions or creams for skin wellness, pharmaceutical or antimicrobial agents for topical application, diaper rash treatments, perfumes and powders, odor control agents such as liquid solutions of cyclodextrin and other additives in a spray bottle, sponges or mop heads for cleaning with disposable high wet strength paper, and the like.

In another embodiment, the webs of the present invention may be used to produce wet wipes such as premoistened bath tissue. For good dispersibility and good wet strength, binders that are sensitive to ion concentration may be used such that the binder provides integrity in a wetting solution that is high in ion concentration, but loses strength when placed in ordinary tap water because of a lower ion strength.

The webs of the present invention may be subsequently treated in any way known in the art. The web may be provided with particles or pigments such as superabsorbent particles, mineral fillers, pharmaceutical substances, odor control agents, and the like, by methods such as coating with a slurry, electrostatic adhesion, adhesive attachment, by application of particles to the web or to the elevated or depressed regions of the web, for example such as application of fine particulates by an ion blast technique and the like. The web may also be calendered, embossed, slit, rewet, moistened for use as a wet wipe, impregnated with thermoplastic material or resins, treated with hydrophobic matter, printed, apertured, perforated, converted to multiply assemblies, or converted to bath tissue, facial tissue, paper towels, wipers, absorbent articles, and the like.

The tissue products of the present invention may be converted in any known tissue product suitable for consumer use. Converting may comprise calendering, embossing, slitting, printing, addition of perfume, addition of lotion or emollients or health care additives such as menthol, stacking preferably cut sheets for placement in a carton or production of rolls of finished product, and final packaging of the product, including wrapping with a poly film with suitable graphics printed thereon, or incorporation into other product forms.

Reference now will be made to various embodiments of the invention, one or more examples of which are set forth below. Each example is provided by way of explanation of the invention, not as a limitation of the invention. In fact, it will be apparent to those skilled in the art that various modifications and variations may be made of this invention without departing from the scope or spirit of the invention.

EXAMPLE 1

To demonstrate the potential for flexographic printing to transfer substantial quantities of a high solids, high-viscosity adhesive material to a paper surface, a reel of commercial coated printing paper was flexographically printed with a hot melt adhesive using the heated flexographic printing equipment of Propheteer International (Lake Zurich, Ill.). The Propheteer 2000 3-Color line was used, comprising an unwind unit, a UV curing station, a flexographic hot melt applicator, a rewind unit, a sheeting station and a stacker. The flexographic applicator was a Flexo Hot Melt Applications Processor manufactured by GRE Engineering Products AG in Steinebrunn, Switzerland (believed to be GRE model HM 220–500). It was adapted to process sheets up to 20 inches wide. The flexographic plate comprised a high-temperature silicone elastomer having a maximum application temperature of 500° F. based on polydimethylsiloxane produced by the Chase Elastomer Division of PolyOne Corporation (Kennedale, Tex.). The Propheteer system further comprises a Flexo UV Silicone Applicator in a Propheteer Label Printing Press, though UV-curing of silicone was not included in these trials. (However, in alternate embodiments, the processes of the present invention may include application of silicone compounds by flexographic printing, followed by UV curing or other curing steps, as needed.)

The web was a coated bleached kraft web that was substantially smooth and relatively non-porous in its coated state, having a basis weight of about 90 gsm. In one series of runs, the Flexo Hot Melt Applications Processor was used to apply the hotmelt Epolene® C-10, a polyethylene-based Epolene®) wax hotmelt manufactured by the Texas Eastman Division of Eastman Chemical (Longview, Tex.). This hotmelt is reported by the manufacturer to have a Brookfield viscosity at 150° C. of 7800, according to Test Method TEX-542-111 of the Texas Eastman Division. Further, Epolene® C-10 is reported to have a density at 25° C. or 0.906 g/ml, a softening point (Ring and Ball Softening Point) of 104° C., a Melt Index at 190° C. of 2250, a weight-averaged molecular weight of 35,000 and a number-averaged molecular weight of 7,700, and a cloud point of 77° C. (for a 2% solution in paraffin at 130° C.). Epolene® waxes are reported to have softening points of 100° C. to 163° C. (Without limitation, useful hot melts may have softening points equal to or greater than any integral temperature value between 90° C. and 250° C.)

In another series of runs, the hotmelt was HM-0727, one of the series of Advantra™ hot melts manufactured by H. B. Fuller Company, St. Paul, Minn.

The cylinder base of the flexographic cylinder was manufactured by Action Rotary Die, Inc. (Addison, Ill.), and the rubber plate on the cylinder was produced by Schawk, Inc. (Des Plaines, Ill.). The rubber plate is vulcanized and laser engraved by Schawk, Inc.

As a preliminary demonstration of the hotmelt applicator, personnel at Propheteer International printed hotmelt with a simple test pattern on the calendered printing paper. The pattern had simple spaced apart bars with a width of 0.5 cm and a length of 4 cm.

Figure 9:
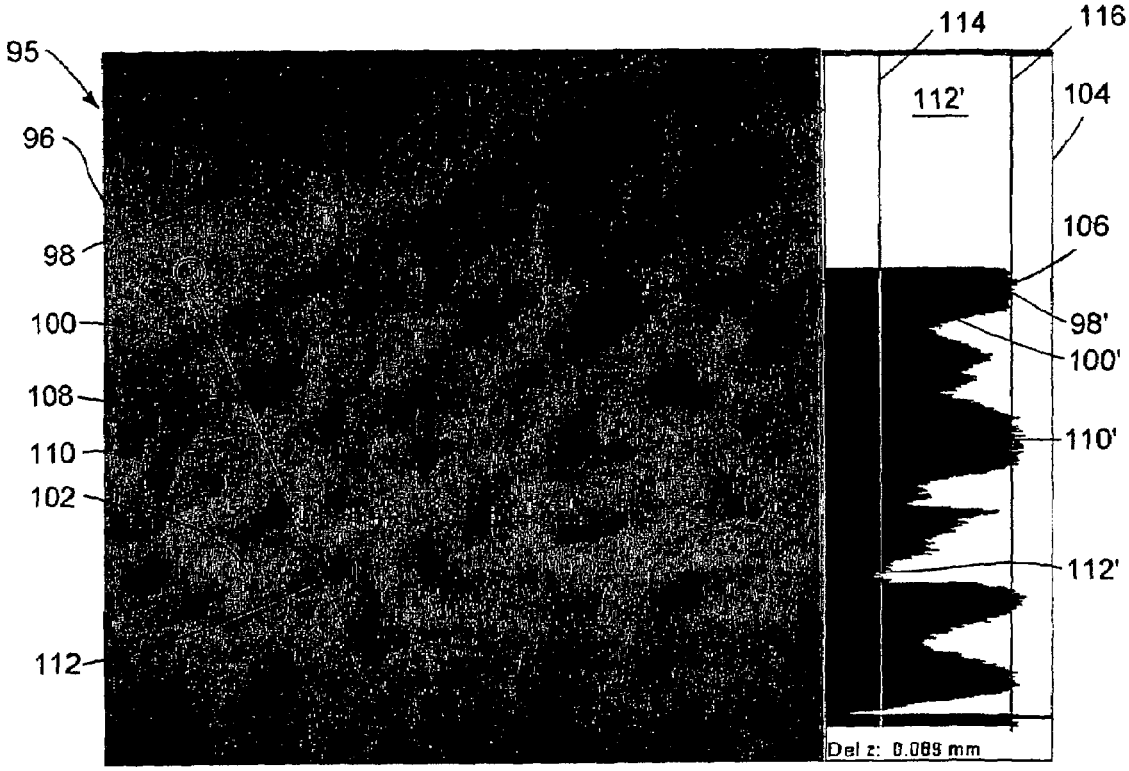
FIG. 9 is a height map of a putty impression of a paper web having islands of flexographically printed hot melt adhesive thereon, showing a profile line from a portion of the height map.

FIG. 9 is a portion of a screen shot 95 comprising a height map 96 of a putty impression of the printed paper web having islands of flexographically printed hot melt adhesive thereon in a bar pattern. The height map 96 represents approximately 250,000 measured points in a region with dimensions of 5.4 by 5.4 mm. In the height map 96, darker regions represent lower portions on the surface of the putty, corresponding to elevated portions on the surface of the web (including the elevated portions of the adhesive material on the web).

In FIG. 9, a smooth region 98 in the upper left-hand corner of the height map 96 corresponds to an unprinted portion of the web. An edge region 100 corresponds to a relatively smooth region within the printed adhesive material along the edge of the printed portions. Away from the edge region 100 is the remaining rough region 102 which reveals the texture typical of most of the flexographically printed bar regions on the web.

The profile display box 104 to the right of the height map 96 shows the topography in the form of a profile 106 taken along a profile line 108 on the height map 96. The topographical features of the profile 106 include a relatively smooth elevated region 98' corresponding to the smooth region 98 of the height map 96; a depressed region 100' corresponding to the edge region 100 of the height map 96; elevated regions 110' corresponding to elevated regions 110 in the rough region 102 of the height map 96; and depressed regions 112' corresponding to depressed regions 112 of the height map 96 which in turn correspond to peaks of adhesive material (not shown) on the paper web.

The magnitude of the Surface Depth of the flexographic printed adhesive material on the web is indicated by the Surface Depth of the profile 106. A first reference line 114 corresponds roughly to the elevation of depressed regions 112 of the profile 106, and a second reference line 116 corresponds roughly to the elevation of elevated regions 110 of the profile 106. The height difference between the first and second reference lines 114, 116 is 0.089 mm, indicating that the adhesive material peaks rise about 0.089 mm above the surface of the web, at least for the portion of printed region pertaining to FIG. 9.

Figure 10:
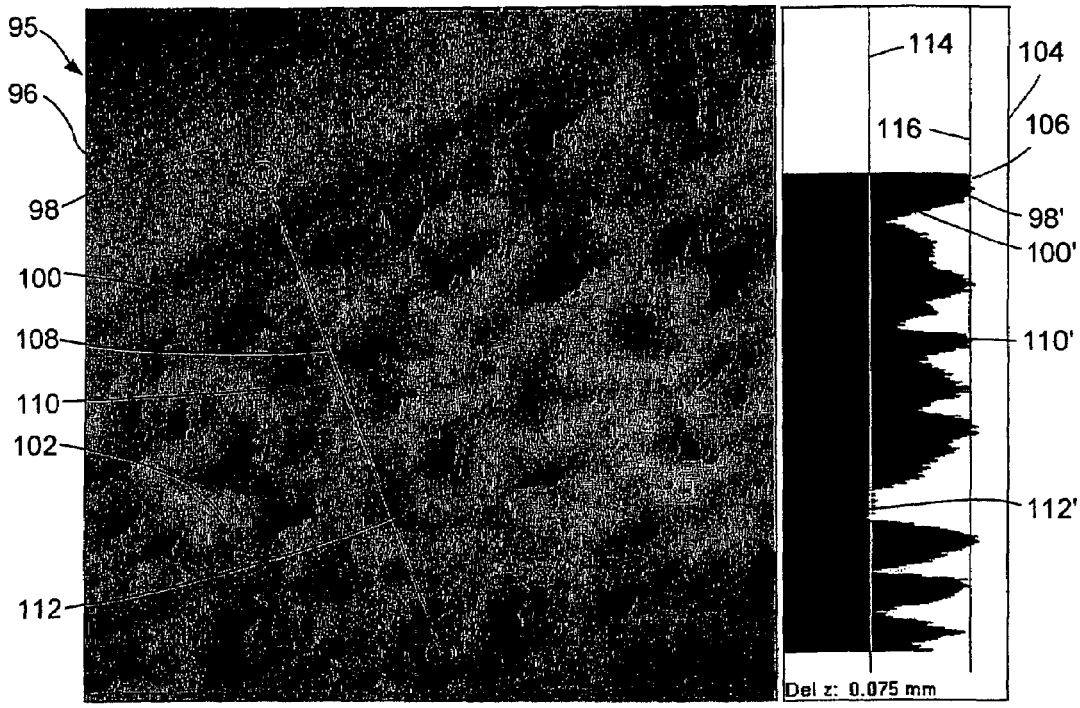
FIG. 10 illustrates the height map of FIG. 9 but showing a different profile line extracted from the height map.

FIG. 10 shows the height map of FIG. 9 but showing a different profile line 108 and its associated profile 106. In this case, the characteristic height spanned by the profile 106 is about 0.075 mm.

The test pattern was then replaced with flexographic plate having a pattern according to FIG. 5. The hot melt adhesive, initially the HM-0727 hot melt, was maintained at a pool temperature of about 300° F. and was applied to the applicator roll at a thickness of about 0.020 inches (0.5 mm) in a smooth flooded nip arrangement, similar to that of FIG. 1, in which the applicator roll rotated at a velocity of about three times that of the counter-rotating roll.

Figure 11:
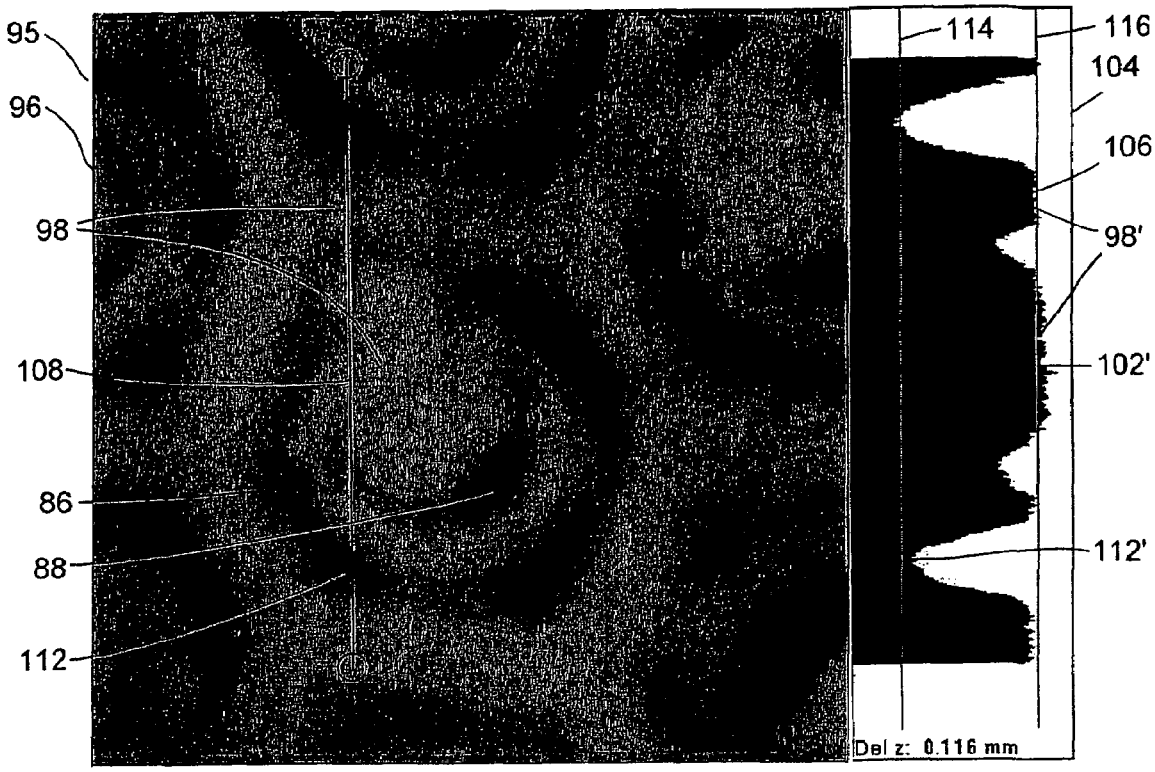
FIG. 11 shows a height map of a putty impression of a paper web flexographically printed with hot melt adhesive with a patterned flexographic plate having a pattern similar to that of FIG. 5.

A putty impression was made of the resulting flexographically printed web, and the CADEYES® system was applied to measure the surface topography of the putty impression. FIG. 11 shows the corresponding height map 96. The height map 96 depicts smooth regions 98 corresponding to the unprinted surface of the web, and comprises a plurality of depressed regions 112 corresponding to printed adhesive material (not shown) rising above the plane of the web. The depressed regions 112 define hexagonal elements 86 and portions of circles 88. The height difference between the first and second reference lines 114, 116 is 0.116 mm, indicating that the adhesive material peaks rise about 0.116 mm above the surface of the web, at least for the portion of printed region pertaining to FIG. 9.

The hot-melt-printed and unprinted webs were then measured for caliper and basis weight, revealing the add-on levels indicated in Table 1 which ranged from about 8 to 11%, relative to the mass of the web. Higher add-on levels may be considered, such as from 8% to 20% or from 8% to 25%. Caliper was measured with a hand-held micrometer to indicate the thickness of a local region of the web which will generally be substantially less than the thickness of the tissue web when measured between two much wider platens at a low load such as 0.05 psi. The hand-held micrometer was a Starrett™ Model No. 1010 from L. S. Starrett Company (Athol, Mass.) with a 0.25" diameter compression head that is spring loaded. A dial indicator gives the caliper reading in increments of 0.0005" inches.

TABLE 1

Hot melt add-on values.

| | Caliper (mm) | | Basis Weight (gsm) | | Add-On |
|---|---|---|---|---|---|
| Sample | unprinted | printed | unprinted | printed | (%) |
| 1 | 0.091 | 0.203 | 90.1 | 100.0 | 11.0 |
| 2 | 0.097 | 0.203 | 91.9 | 100.8 | 9.7 |
| 3 | 0.091 | 0.188 | 90.4 | 97.7 | 8.1 |
| 4 | 0.089 | 0.203 | 90.4 | 99.5 | 10.1 |

Printing was also done with the Epolene™ C-10 hot melt and the same pattern.

EXAMPLE 2

Both hotmelts described in Example 1 were printed with two different patterns according to Example 1, but on a high bulk, resilient, three-dimensional uncreped through-dried web.

The uncreped web was formed in a similar method to that disclosed in Example 1 of U.S. Pat. No. 6,395,957 to Chen, et al. (herein incorporated by reference as to all relevant matter). The base sheet was produced on a continuous tissue-making machine adapted for uncreped through-air drying, similar to the machine configuration shown in FIG. 4 of Chen, et al. The machine comprised a Fourdrinier forming section, a transfer section, a through-drying section, a subsequent transfer section and a reel.

The process included a three-layered headbox to form a web with three layers. The two outer layers in the three-layered headbox comprised dilute pulp slurry (about 1% consistency) made from LL19 pulp, a southern softwood bleached kraft pulp of Kimberly-Clark Corp., (Dallas, Tex.). The central layer was made from a 50/50 mix of LL19 pulp and bleached chemithermo-mechanical pulp (BCTMP), pulped for 45 minutes at about 4% consistency prior to dilution. The BCTMP is commercially available as Millar-Western 500/80/00 (Millar-Western, Meadow Lake, Saskatchewan, Canada). The mass split of the layered web, based on fiber throughput to the layered sections of the headbox, as 25% for both of the outer layers and 50% for the inner layer, in a web with a basis weight if 52 grams per square meter (gsm).

No wet strength agents or starches were added to the web. A debonder was added to the slurry forming the two outer layers. The debonder was a quaternary ammonium compound, ProSoft TQ1003 made by Hercules, Inc. (Wilmington, Del.) added at a dose of 5 kg/per ton of dry fiber. The slurry was then deposited on a fine forming fabric and dewatered by vacuum boxes to form a web with a consistency of about 12%. The web was then transferred to a transfer fabric using a vacuum shoe at a first transfer point with no significant speed differential between the two fabrics. The web was further transferred from the transfer fabric to a woven through-drying fabric at a second transfer point using a second vacuum shoe. The through drying fabric used was a Lindsay Wire T-1203-1 design (Lindsay Wire Division, Appleton Mills, Appleton, Wis.), based on the teachings of U.S. Pat. No. 5,429,686 issued to Chiu et al., herein incorporated by reference. The T-1203-1 fabric is well suited for creating molded, three-dimensional structures. At the second transfer point, the through-drying fabric was traveling more slowly than the transfer fabric, with a velocity differential of 45% (45% rush transfer). The web was then passed into a hooded through dryer where the sheet was dried. The dried sheet was then transferred from the through-drying fabric to another fabric, from which the sheet was reeled. The sheet had a thickness of about 1 mm (44.2 mils), a geometric mean tensile strength of about 665 grams per 3 inches (measured with a 4-inch jaw span and a 10-inch-per minute crosshead speed at 50% relative humidity and 22.8° C.), An MD:CD tensile strength ratio of 1.07; 9.9% CD stretch.

A roll of the uncreped web was placed in the unwind stand of the Propheteer 2000 3-Color line described in Example 1. The flexographic gap was adjusted to accommodate the basesheet (thickness about 1 mm) without significant densification of the web. Printing with the HM-0727 adhesive and the Epolene™ C-10 wax yielded results in which the applied hotmelt did not closely match the intended pattern. There appeared to be a degree of bleeding and there were numerous fibrous hotmelt threads on the surface. This distribution of hotmelt is not necessarily undesirable. But in order to achieve a crisper application of hotmelt more closely corresponding to the flexographic print pattern, the pattern was made less fine by removing the dots and circles in the pattern of FIG. 5. The removal of the dots and circles inside the hexagons on the flexographic plate was achieved by using a hand drill, repeatedly drilling away the elevated structures inside the hexagons of a section of the roll. The modified portion of the flexographic plate gave significantly improved definition in the prinw3. ted pattern. Definition was checked by adding a blue pigment to the hotmelt to more clearly observe its location in the web.

EXAMPLE 3

To demonstrate flexographic printing of a synthetic latex emulsion, runs were conducted on a Kimberly-Clark pilot printing facility in Neenah, Wis. A four-roll flexographic system, substantially as shown in FIG. 13, was used, but typically with adhesive applied on one side only. The flexographic system was manufactured by Retroflex, Inc. of Wrightstown, Wis. Flexographic plates were prepared with the three patterns shown in FIGS. 14A–14C.

A roll of the unprinted, uncreped through-air dried tissue made according to Example 2 was positioned in an unwind stand from which it was guided through the flexographic press. The flexographic printer was configured for single side application with a gap offset of 0.003" inch. Printed latex was dried as the web passed through an infrared oven set at 380° F. (not shown in FIG. 13). The web with the dried latex was then wound into a roll. The unwind, flexographic printing system, oven drying and curing and rewind units were synchronized for matched web surface speed. The flexographic pattern printer applied the latex print medium to the basesheet.

Calibration of the pattern printing plate gap relative to the backing roll was conducted for uniform fluid application to the basesheet. The gap was measured as being 0.0085" inch, and raw caliper (the thickness of the web entering the nip) was 32.2 mils as measured with the previously described Starrett™ Model No. 1010 hand micrometer from L. S. Starrett Company (Athol, Mass.). Raw calipers from 11.0 to 48.6 were possible with the system. The flexographic print system allows flexible durable print contact with minimum impression pressure, such as about 0.25 pli. or less. The nip width (machine direction length of contact in the nip) was approximately 0.25 inches, uniformly observed across the width of the machine. Nip widths may exceed 0.75 inches depending on the Durometer value of the pattern plate material used or impression pressure.

The latex applied was AirFlex™ EN1165 latex, manufactured by Air Products (Allentown, Pa.). Following application of latex, printed tissue was cured at 300° F. in an Emerson Speed Dryer Model 130 (Emerson Apparatus, Portland, Me.). Curing at elevated temperature was needed because the latex was used without catalyst.

Latex was applied at solids levels of 25%, 30%, 35% 40%, 45% and 50% though solids levels from about 3–5% up to 100% could be applied. Drying time of the latex increased with increasing solids level making it more difficult to process effectively. Add-on levels for the uncreped basesheet were generally 5% to 10%, with about 7% being typical.

A normal backing roll consists of a 100% surface smooth steel to fully support the pattern graphic impression onto the basesheet. In duplex printing, each pattern roll relies on the opposing roll for support to print the basesheet. In each series of runs, the pattern print plates used the print pattern of FIG. 14B which provided 41.16% graphic coverage, (41.16% of the plate surface area is occupied by elevated printing areas), so approximately 59% of the pattern print plate was non-print areas or voids. In this pattern, the width of hexagonal cells from one side to the opposing parallel side was 3.8 mm and the line width was 96.5 microns. Both pattern print plates were run with non-registered alignment of back-to-back patterns. (Registered back-to-back pattern print plates are another setup using a matched alignment and gaining 100% backing support for a total impression of the pattern print plate.) Latex was applied to the tissue web under a variety of run conditions with the duplex printing system.

Figure 14A:
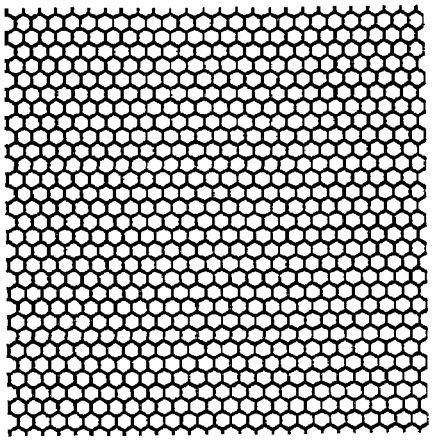
FIGS. 14A, 14B, and 14C depict patterns used in flexographic printing of a tissue web.

In one series of runs, latex at 35% solids was applied with the control pattern of FIG. 14A. Run conditions were conducted by altering the gap width, with higher gap width resulting in lower applied pressure and apparently causing less penetration of the adhesive into the tissue web. Tensile strength results are shown in the table given in FIG. 15, where significant gains in tensile strength and stretch are observed when the gap was reduced to 0.002 inches or 0.004 inches. The reported caliper is for a single sheet measured with an Emveco Model 200A Electronic Microgage (EMVECO Inc., Newberg, Oreg.), operating with an applied load of 0.289 psi and a 2.22-inch diameter platen. Tensile strength was measured with a 4-inch gauge length, a 3-inch width, and a crosshead speed of 10 inches per minute.

Figure 14B:
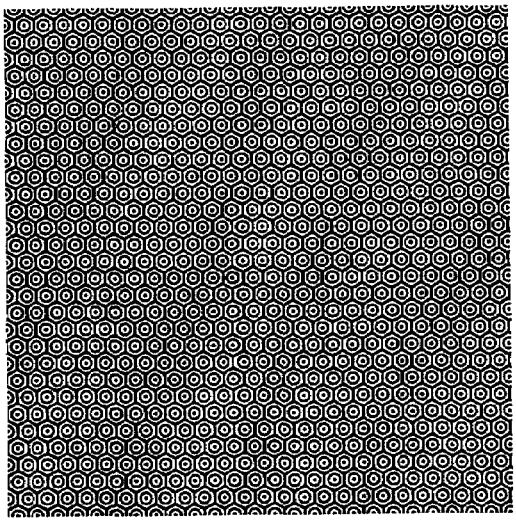
Figure 14C:
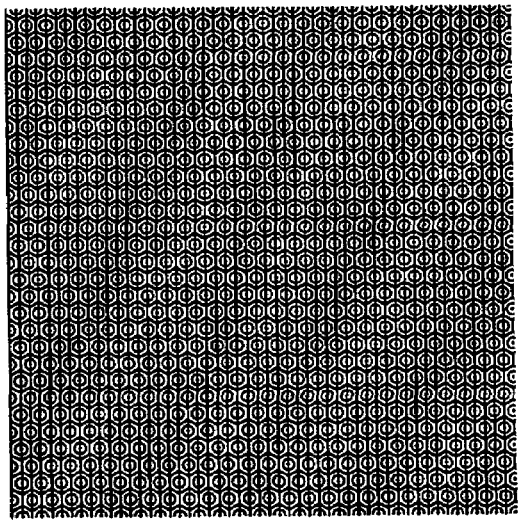

In another series of runs, several latex solids levels were used and all three printing patterns in FIGS. 14A–14C. were used to create the runs listed in Table 2. The physical properties of the resulting latex-printed tissue are given in Table 3.

TABLE 2

Conditions for Runs with Various Flexographic Patterns

| Run | Flexographic Pattern | Screen Density | Latex Solids |
|---|---|---|---|
| Run 1 | FIG. 14A | 100% | 35% |
| Run 2 | FIG. 14A | 100% | 45% |
| Run 3 | FIG. 14A | 90% | 45% |
| Run 4 | FIG. 14A | 90% | 35% |
| Run 5 | FIG. 14B | 90% | 35% |
| Run 6 | FIG. 14B | 90% | 45% |
| Run 7 | FIG. 14C | 100% | 45% |
| Run 8 | FIG. 14C | 100% | 35% |

TABLE 3

Measured Properties for the Runs of Table 2.

| Run | Caliper (mils) | Caliper Retention | MD Tensile (grams) | CD Tensile (grams) | Cured Wet CD (grams) | Wet/Dry | GMT | MD/CD |
|---|---|---|---|---|---|---|---|---|
| Base-sheet | 27.5 | NA | 670 | 503 | — | — | 581 | 1.33 |
| Run 1 | 19.7 | 71.6% | 1320 | 821 | 236 | 28.7% | 1041 | 1.61 |

TABLE 3-continued

Measured Properties for the Runs of Table 2.

| Run | Caliper (mils) | Caliper Retention | MD Tensile (grams) | CD Tensile (grams) | Cured Wet CD (grams) | Wet/Dry | GMT | MD/CD |
|---|---|---|---|---|---|---|---|---|
| Run 2 | 22 | 80.0% | 1511 | 1076 | 325 | 30.2% | 1275 | 1.40 |
| Run 3 | 20.2 | 73.5% | 1245 | 1006 | 313 | 31.2% | 1119 | 1.24 |
| Run 4 | 22.8 | 82.9% | 1413 | 1071 | 312 | 29.2% | 1230 | 1.32 |
| Run 5 | 22 | 80.0% | 1471 | 1133 | 369 | 32.6% | 1291 | 1.30 |
| Run 6 | 22.3 | 81.1% | 1599 | 1226 | 482 | 39.4% | 1400 | 1.30 |
| Run 7 | 22.4 | 81.5% | 1453 | 1113 | 419 | 37.7% | 1272 | 1.31 |
| Run 8 | 20.5 | 74.5% | 1781 | 1305 | 486 | 37.3% | 1524 | 1.37 |

Printing with latex resulted in significant increases in wet and dry tensile strength. The printing process resulted in some loss in bulk, with roughly 80% of the caliper of the web being retained (about 20% of the bulk was lost). Without wishing to be bound by theory, it is believed the use of a water-containing adhesive such as latex may result in some collapse of a dry bulky web, particularly when the web is compressed during or after printing, unless further steps are taken to increase or preserve bulk, such as applying adhesive to the web and at least particularly drying or curing the web as it is held in a three-dimensional, textured configuration to impart added bulk to the web maintained by the adhesive material. Larger print gaps more resilient basesheets may have also resulted in greater caliper retention.

It will be appreciated that the foregoing examples, given for purposes of illustration, are not to be construed as limiting the scope of this invention. Although only a few exemplary embodiments of this invention have been described in detail above, those skilled in the art will readily appreciate that many modifications are possible in the exemplary embodiments without materially departing from the novel teachings and advantages of this invention. Accordingly, all such modifications are intended to be included within the scope of this invention which is defined in the following claims and all equivalents thereto. Further, it is recognized that many embodiments may be conceived that do not achieve all of the advantages of some embodiments, yet the absence of a particular advantage shall not be construed to necessarily mean that such an embodiment is outside the scope of the present invention.

What is claimed is:

1. A process for printing an adhesive material on a paper web to form a paper product comprising:

providing a paper web;

flexographically printing an adhesive material on one side of the web in a pattern, wherein the printing process exerts a peak pressure on the web of between about 0.2 and about 30 psi, wherein the adhesive material has a Brookfield viscosity at 20 rpm of about 20 poise or greater, and wherein the adhesive material is selected from the group consisting of latex adhesives, hot melt adhesives, pressure sensitive adhesives, rubber based adhesives, and acrylic adhesives;

molding the paper web into a three dimensional state defined by a pattern of raised web portions; and curing the adhesive material, the adhesive material being located on the web such that the cured adhesive material prevents the three-dimensional state of the web from relaxing into a substantially two dimensional state, and wherein the side of the paper web printed with the adhesive material is an exposed outer side of the formed paper product.

2. The process of claim 1, wherein the flexographic printing process includes guiding the web through a printing nip comprising interdigitating rolls.

3. The process of claim 2, wherein the web is microstrained in the printing nip.

4. The process of claim 1, wherein the adhesive material is a hot melt adhesive material.

5. The process of claim 1, further comprising printing the adhesive material onto the other side of the web by use of a low pressure printing process.

6. The process of claim 1, further comprising printing an additive on the web by use of a low pressure printing process.

7. The process of claim 1, wherein the pattern of adhesive material is heterogeneous across the surface of the web.

8. The process of claim 1, wherein the web is molded into a three dimensional state before the web is printed with the adhesive material.

9. The process of claim 1, wherein the web is molded into a three dimensional state after the web is printed with the adhesive material.

10. The process of claim 1, wherein the web is molded into a three-dimensional state at substantially the same time that the web is printed with the adhesive material.

11. The process of claim 1, wherein the web comprises two or more plies.

12. The process of claim 11, wherein the plies are joined together by mechanical means.

13. The process of claim 11, wherein the plies are joined together by adhesive means.

14. The process of claim 11, wherein the plies are dissimilar.

15. The process of claim 1, wherein the web comprises an uncreped tissue web.

16. The process of claim 1, wherein the web comprises a creped tissue web.

17. The process of claim 1, wherein the paper product formed is a single ply paper product.

18. A process for producing a paper web to form a paper product comprising:

forming a paper web comprising papermaking fibers;

molding the paper web into a three dimensional state defined by a pattern of raised web portions, wherein the web is molded by being subjected to a molding pressure which does not cause significant deformation of the papermaking fibers;

printing an adhesive material on one side of the web in a first pattern by use of a flexographic printing process which exerts a peak pressure on the web of between about 0.2 and about 30 psi, wherein the adhesive has a Brookfield viscosity at 20 rpm of about 20 poise or greater, and wherein the adhesive material is selected from the group consisting of latex adhesives, hot melt adhesives, pressure sensitive adhesives, rubber based adhesives, and acrylic adhesives; and curing the adhesive material, the adhesive material being located on the web such that the cured adhesive material prevents the three-dimensional state of the web from relaxing into a substantially two dimensional state, and wherein the side of the paper web printed with the adhesive material is an exposed outer side of the formed paper product.

19. The process of claim 18, wherein the paper web is molded into the three dimensional state before the adhesive material is printed on the web.

20. The process of claim 18, wherein the paper web is molded into the three dimensional state after the adhesive material is printed on the web.

21. The process of claim 18, wherein the web is molded in the flexographic printing nip.

22. The process of claim 18, wherein the flexographic printing nip comprises interdigitating rolls.

23. The process of claim 22, further comprising microstraining the web.

24. The process of claim 18, wherein the web is molded into a three-dimensional state by pressing the web against a molding substrate.

25. The process of claim 24, wherein the web is pressed against a molding substrate by a pneumatic force.

26. The process of claim 25, wherein the differential pressure across the web during said molding is between about 1 and about 200 kPa.

27. The process of claim 25, wherein the differential pressure across the web during said molding is between about 5and about 150 kPa.

28. The process of claim 18, wherein the first pattern of adhesive material comprises the areas of the web at the base of the raised web portions.

29. The process of claim 18, wherein the flexographic printing process does not include an impression cylinder.

30. The process of claim 18, further comprising printing an additive on the web.

31. The process of claim 18, further comprising printing the adhesive material on the second side of the web.

32. The process of claim 31, wherein the adhesive material is printed onto both sides of the web at the same time.

33. The process of claim 31, wherein the adhesive material is printed on the second side of the web in a second flexographic printing process.

34. The process of claim 18, wherein the pattern of adhesive material is heterogeneous across the surface of the web.

35. The process of claim 18, wherein the web comprises two or more plies.

36. The process of claim 35, wherein the plies are dissimilar.

37. The process of claim 18, wherein the web comprises a wetlaid tissue web.

38. The process of claim 18, wherein the web comprises an airlaid web.

39. The process of claim 18, wherein the paper product formed is a single ply paper product.

* * * * *

UNITED STATES PATENT AND TRADEMARK OFFICE

CERTIFICATE OF CORRECTION

PATENT NO. : 7,182,837 B2
APPLICATION NO. : 10/305791
DATED : February 27, 2007
INVENTOR(S) : Chen et al.

It is certified that error appears in the above-identified patent and that said Letters Patent is hereby corrected as shown below:

Column 42, line 3 (Claim 27) “about 5and” should read --about 5 and--

Signed and Sealed this

Twenty-eighth Day of August, 2007

JON W. DUDAS
*Director of the United States Patent and Trademark Office*